US011478057B2

(12) United States Patent
Nasu

(10) Patent No.: US 11,478,057 B2
(45) Date of Patent: Oct. 25, 2022

(54) FEEDING CONTAINER, DISCHARGE DEVICE, AND CUSTOMIZED DISCHARGE SYSTEM

(71) Applicant: SHISEIDO COMPANY, LTD., Tokyo (JP)

(72) Inventor: Mieko Nasu, Tokyo (JP)

(73) Assignee: SHISEIDO COMPANY, LTD., Tokyo (JP)

( * ) Notice: Subject to any disclaimer, the term of this patent is extended or adjusted under 35 U.S.C. 154(b) by 10 days.

(21) Appl. No.: 17/269,316

(22) PCT Filed: Aug. 28, 2019

(86) PCT No.: PCT/JP2019/033806
§ 371 (c)(1),
(2) Date: Feb. 18, 2021

(87) PCT Pub. No.: WO2020/054435
PCT Pub. Date: Mar. 19, 2020

(65) Prior Publication Data

US 2021/0307485 A1 Oct. 7, 2021

(30) Foreign Application Priority Data

Sep. 10, 2018 (JP) ..... JP2018-169200

(51) Int. Cl.
*A45D 34/04* (2006.01)

(52) U.S. Cl.
CPC ..... *A45D 34/04* (2013.01); *A45D 2200/055* (2013.01)

(58) Field of Classification Search
CPC ..... B01F 33/846; B01F 35/717613; B01F 33/841; A45D 2200/058; A45D 2034/005;
(Continued)

(56) References Cited

U.S. PATENT DOCUMENTS 1,659,912 A * 2/1928 Geake ..... B65D 83/0011 222/390
2,373,444 A * 4/1945 Azpiazu ..... B65D 83/0011 222/153.13

(Continued)

FOREIGN PATENT DOCUMENTS

EP 0443519 A2 * 8/1991 ..... B65D 21/0204
JP 2006-124007 5/2006

(Continued)

OTHER PUBLICATIONS

International Search Report for PCT/JP2019/033806 dated Nov. 26, 2019.

(Continued)

*Primary Examiner* — Patrick M. Buechner
(74) *Attorney, Agent, or Firm* — IPUSA, PLLC

(57) ABSTRACT

A feeding container includes a container body capable of accommodating contents, and a nozzle provided in an upper portion of the container body, and the contents accommodated in the container body is discharged from the nozzle. The nozzle extends in a horizontal direction, and pushes out the contents in the horizontal direction via a discharge hole opening in the horizontal direction, and a projection which projects in a direction intersecting an extending direction of the nozzle is provided on an extending side surface of the nozzle.

13 Claims, 23 Drawing Sheets

(58) Field of Classification Search
CPC .. A45D 34/04; A45D 2200/055; A45D 34/00; A45D 44/005; B65D 83/0011; B65D 83/0005–83/005
See application file for complete search history.

(56) References Cited

U.S. PATENT DOCUMENTS

| | | | | |
|---|---|---|---|---|
| 5,356,049 | A | 10/1994 | Harris et al. | |
| 8,864,401 | B2 | 10/2014 | Duru | |
| 10,076,175 | B2 * | 9/2018 | Wee | A61M 35/003 |
| 2013/0223913 | A1 | 8/2013 | Duru | |
| 2017/0340087 | A1 | 11/2017 | Samain et al. | |
| 2017/0360178 | A1 * | 12/2017 | Samain | A45D 40/26 |
| 2020/0207538 | A1 * | 7/2020 | Nasu | B65D 83/682 |
| 2020/0405039 | A1 * | 12/2020 | Jung | B05B 11/00 |
| 2021/0235846 | A1 * | 8/2021 | Clappaz | B05B 11/3084 |
| 2021/0236863 | A1 * | 8/2021 | Suwanto | G06V 40/169 |

FOREIGN PATENT DOCUMENTS

| | | | |
|---|---|---|---|
| JP | 2013-537811 | 10/2013 | |
| JP | 5868678 | 2/2016 | |
| JP | 2017-214114 | 12/2017 | |
| JP | 2017-537699 | 12/2017 | |
| KR | 10-0799165 | 1/2008 | |
| KR | 101488673 B1 * | 2/2015 | B05B 11/00416 |

OTHER PUBLICATIONS

Office Action issued in counterpart Chinese Patent Application No. 201980058528.5, dated May 7, 2022.

* cited by examiner

FEEDING CONTAINER, DISCHARGE DEVICE, AND CUSTOMIZED DISCHARGE SYSTEM

TECHNICAL FIELD

The present invention relates to feeding containers, discharge devices having a plurality of feeding containers, and customized discharge systems including the discharge device.

BACKGROUND ART

Recently, systems which simultaneously discharge a plurality of cosmetic products have been proposed. In these systems, the color, texture, or the like of the plurality of cosmetic products are customized each time and discharged.

As an example of such systems, the system according to Patent Document 1 forms a plurality of discharge holes in a cap at an upper surface, and separately discharges contents from each of the plurality of discharge holes. Cartridges that are used as accommodating parts of such a system are stretched linearly to discharge the contents upward (refer to Patent Document 1, for example).

On the other hand, as a configuration for simultaneously discharging a plurality of contents in a horizontal direction, a pump type discharge device which simultaneously discharges the contents from a plurality of lateral discharge nozzles has been proposed (Patent Document 2).

PRIOR ART DOCUMENT

Patent Document

Patent Document 1: Japanese Laid-Open Patent Publication No. 2017-537699

Patent Document 2: Japanese Patent No. 5868678

DISCLOSURE OF THE INVENTION

Problems to be Solved by the Invention

However, because the plurality of cartridges used in Patent Document 1 discharge the plurality of contents from the separate discharge holes (feed orifices) in the upper surface, end components having feed passages corresponding to the respective cartridges may be required above the cartridges. For this reason, according to this configuration, for example, when replacing the cartridge with another type, it was necessary to replace the end component together with the cartridge.

In addition, because the discharge device according to Patent Document 2 is the pump type, a discharge amount per push is fixed, and it is not possible to finely adjust the discharge amount.

Accordingly, in view of the circumstances described above, it is one object of the present invention to provide a feeding container which can finely adjust the discharge amount, and discharge the contents in the horizontal direction, thereby eliminating the need for a feed passage with respect to a discharge opening of a device to which the feeding container is attached.

Means for Solving the Problems

In order to solve the above problem, according to one aspect of the present invention, a feeding container includes a container body capable of accommodating contents, and a nozzle provided in an upper portion of the container body, the contents contained in the container body being discharged from the nozzle as a piston provided inside the container body rises, wherein the nozzle extends in a horizontal direction, and pushes out the contents in the horizontal direction via a discharge hole which opens in the horizontal direction, and wherein an extending side surface of the nozzle is provided with a projection which projects in a direction intersecting an extending direction of the nozzle.

Effects of the Invention

According to one aspect, a feeding container can finely adjust the discharge amount, and discharge the contents in the horizontal direction, thereby eliminating the need for a feed passage with respect to a discharge opening of a device to which the feeding container is attached.

MODE OF CARRYING OUT THE INVENTION

Figure 1:
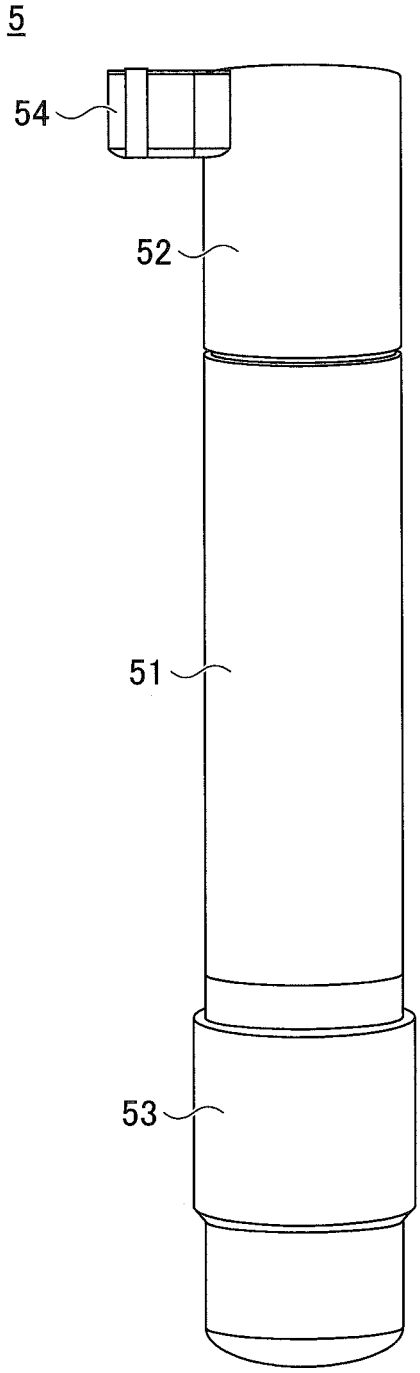
FIG. 1 is an external view of a feeding container according to one embodiment of the present invention.

Hereinafter, embodiments according to the present invention will be described with reference to the drawings. In each of the following drawings, the same elements are designated by the same reference numerals, and a description of the same elements may be omitted.

The present invention relates to feeding containers, discharge devices, and customized discharge systems including a plurality of discharge devices. The feeding container of the present invention may contain, as contents thereof, cosmetic materials (foundation cosmetic materials, base makeup materials, and point makeup materials), solid perfumes, seasonings, or the like.

<Feeding Container>

FIG. 1 is an external view of the feeding container according to one embodiment of the present invention.

As illustrated in FIG. 1, a feeding container 5 includes a container body, as an accommodating case, and a feeding section 53 connected to the container body.

In this embodiment, the container body includes a body cylinder 51 having a side surface, and a head section 52 which is set to cover an upper end of the body cylinder 51.

Figure 2A:
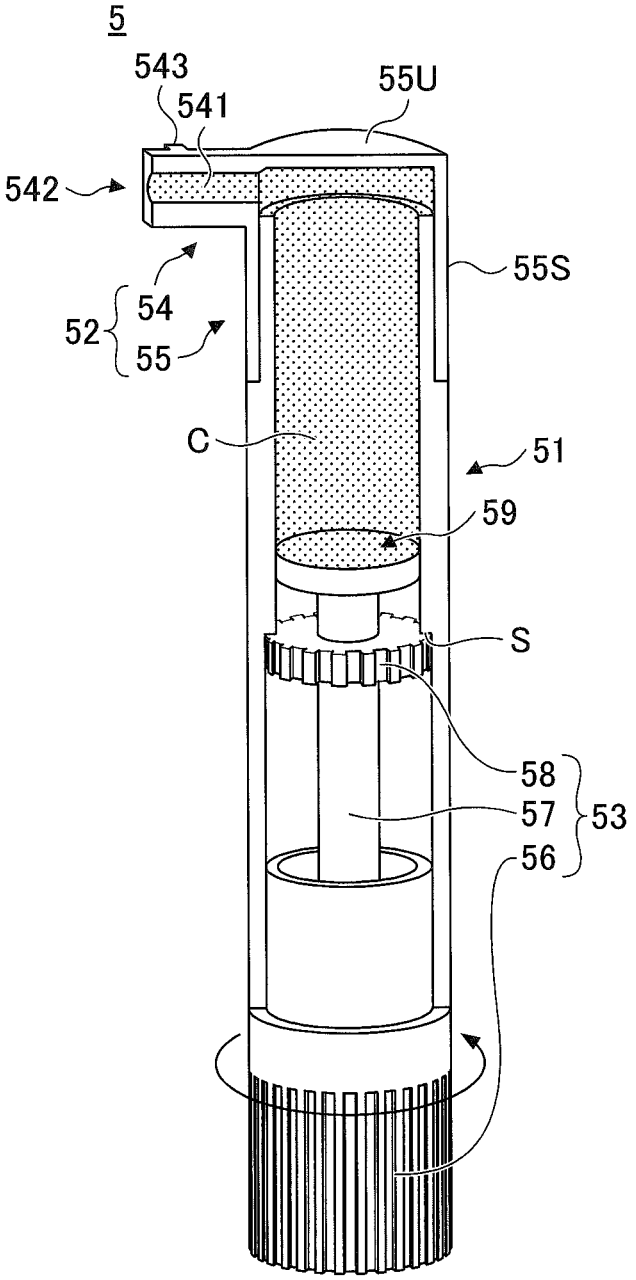
FIG. 2A is a view in partial cross section illustrating the feeding container according to one embodiment of the present invention.

The head section 52 includes a nozzle 54, and a head base 55 (refer to FIG. 2A). The head base 55 is a cap-shaped member having a side surface extending in the same direction as the body cylinder 51, and an upper surface. The nozzle 54 extends in a horizontal direction from the head base 55, and pushes out the contents in the horizontal direction. In this example, as illustrated in FIG. 1, an upper surface of the nozzle 54 is formed so as to extend in the horizontal direction continuously from at least a portion of the upper surface of the head base 55 of the head section 52.

The feeding section 53 is fitted to a lower portion of the body cylinder 51, and rotates with respect to the container body, thereby raising a piston 59 (refer to FIG. 2A) and reducing an internal volume of a filling space inside the container body.

Figure 2B:
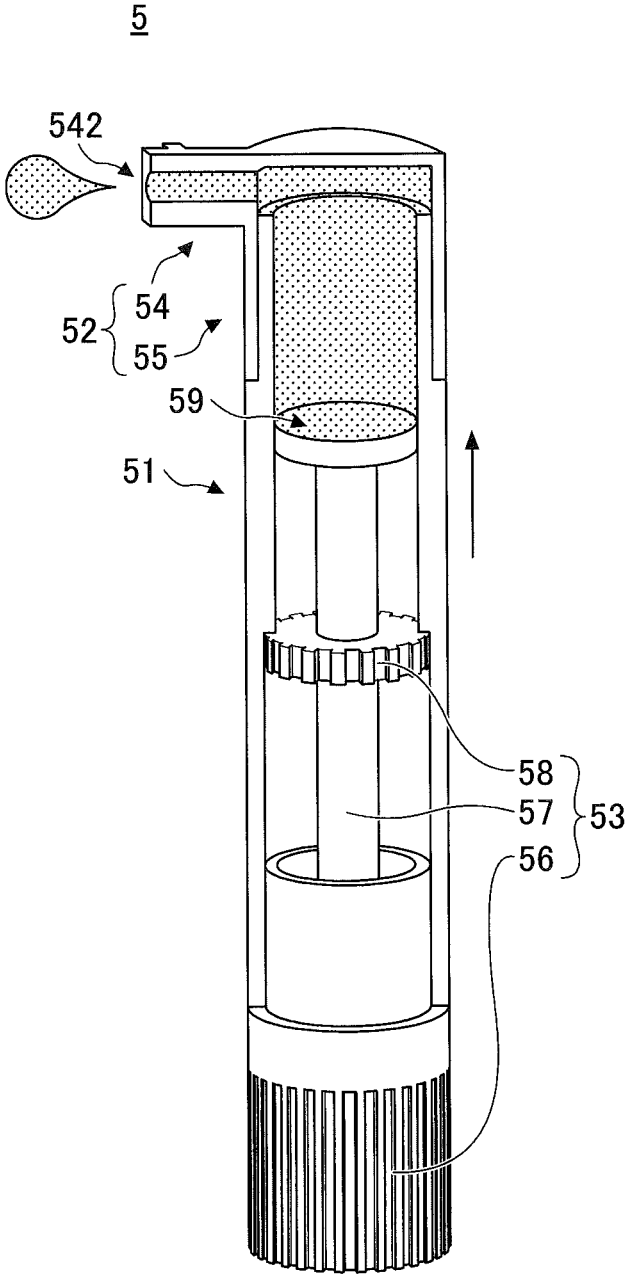
FIG. 2B is a view in partial cross section illustrating the feeding container according to one embodiment of the present invention in a state where a piston is raised compared to the state illustrated in FIG. 2A.

FIG. 2A and FIG. 2B are views in partial cross section illustrating the feeding container 5 according to one embodiment of the present invention. In FIG. 2A and FIG. 2B, the body cylinder 51 and the head section 52 are illustrated in cross sectional views, and the feeding section 53 is illustrated in a perspective view.

As illustrated in FIG. 2A and FIG. 2B, the piston 59, which is movable up and down inside the body cylinder 51, is provided in the body cylinder 51. FIG. 2A illustrates a state where the piston 59 is located at a predetermined position, and FIG. 2B illustrates a state where the piston 59 is raised compared to the state illustrated in FIG. 2A.

A portion above the piston 59 in the body cylinder 51, and a space surrounded by the head section 52, form the filling region filled with contents C.

In the head section 52, a nozzle passage 541 is formed inside the nozzle 54, and a discharge hole 542, which is a nozzle hole (feeding hole), is formed at an end of the head section 52. The head base 55 is a portion which is set to cover the upper end of the body cylinder 51, and has a side surface 55S and an upper surface 55U. The nozzle 54 of the head section 52, and the head base 55, are integrally foisted.

The feeding section 53 includes an operation cylinder 56, a moving shaft 57, and a rotation restricting section 58. The operation cylinder 56 is provided at a lower end of the body cylinder 51 in a relatively rotatable manner. The moving shaft 57 is accommodated so as to penetrate inside the body cylinder 51 and the operation cylinder 56, and a top end of the moving shaft 57 is connected to the piston 59.

The rotation restricting section 58 has a ring shape, and is fitted to a step S where the diameter changes in the body cylinder 51.

A spiral groove (not illustrated) is formed in an outer periphery of the moving shaft 57, and engaging projections (not illustrated) are formed on an inner periphery of the ring-shaped rotation restricting section 58. When the moving shaft 57 rotates, the moving shaft 57 moves in an up-and-down direction with respect to the rotation restricting section 58.

More particularly, when the operation cylinder 56 is rotated relative to the body cylinder 51, the position of the moving shaft 57 with respect to the rotation restricting section 58 rises due to rotation of the moving shaft 57 accommodated in the body cylinder 51 and the operation cylinder 56. As a result, the piston 59 connected to the tip end of the moving shaft 57 rises, thereby reducing the internal volume of the filling space of the head section 52 and the body cylinder 51, and pushing the contents C upward. Accordingly, the contents C are pushed out through the nozzle passage 541 outside the discharge hole 542.

According to this configuration, the moving shaft 57 does not penetrate the piston 59, and is arranged only at a lower end of the piston 59. Accordingly, because the moving shaft 57 is not arranged above the piston 59, the contents C above the piston 59 can be pushed out without adhering to the moving shaft 57.

In addition, according to this configuration, the discharge amount pushed out from the discharge hole 542 corresponds to a rising distance of the piston 59, and the rising distance of the piston 59 corresponds to a rotation amount of the operation cylinder 56. For this reason, it is possible to finely adjust the discharge amount (feeding supply amount) by adjusting the rotation amount of the operation cylinder 56.

Figure 3A:
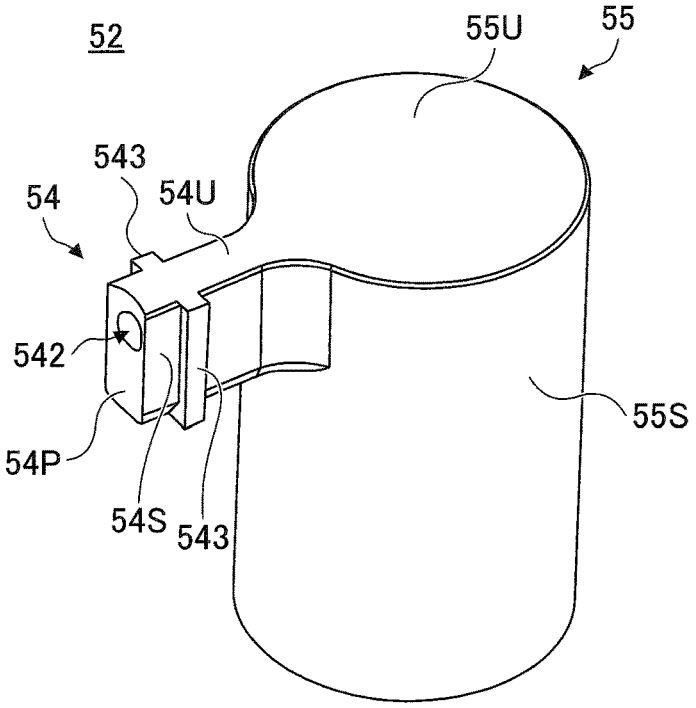
FIG. 3A is a perspective view illustrating a head section of the feeding container of FIG. 1.
Figure 3B:
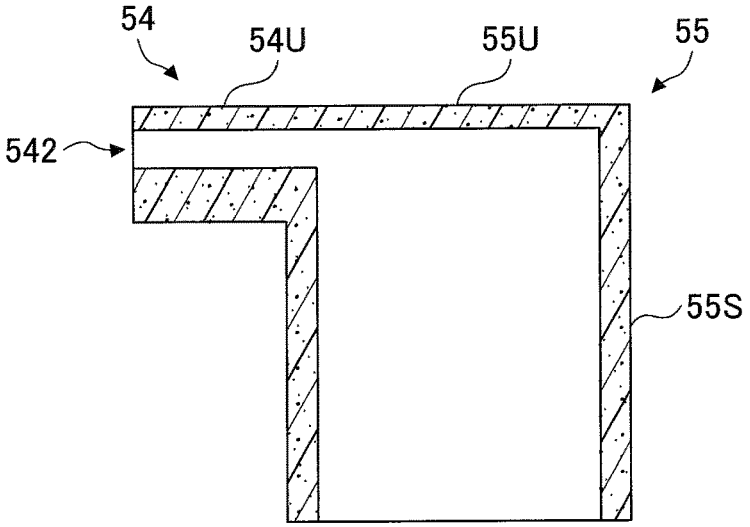
FIG. 3B is a cross sectional view illustrating the head section of the feeding container illustrated in FIG. 1.

FIG. 3A and FIG. 3B are diagrams illustrating the head section 52 of the feeding container 5 illustrated in FIG. 1, where FIG. 3A is a perspective view, and FIG. 3B is a cross sectional view.

As illustrated in FIG. 3A, an extending side surface 54S of the nozzle 54 is provided with a projection 543 projecting in a direction perpendicular to the extending direction of the nozzle 54. In this example, the projection 543 projects in the direction perpendicular to the extending direction of the nozzle 54, however, in order to restrict the rotation of the head section 52 as will be described later, the projection 543 may be engageable with a columnar body 2 and project so as to intersect the nozzle 54, regardless of a projection angle of the projection 543 with respect to the extending direction of the nozzle 54.

Moreover, the nozzle 54 has an external shape that extends in the horizontal direction in a rectangular column shape, except for a connecting portion which connects to the side surface 55S of the head base (container body) 55, and the discharge hole 542 of the nozzle 54 is positioned at an upper portion of a nozzle discharge surface 54P.

Further, as illustrated in FIG. 3B, in the head section 52, the nozzle 54 is integrally formed with the head base 55, so that an upper surface 54U of the nozzle 54 extends in the horizontal direction continuously from the upper surface 55U of the head base 55.

<First Modification>

Figure 4:
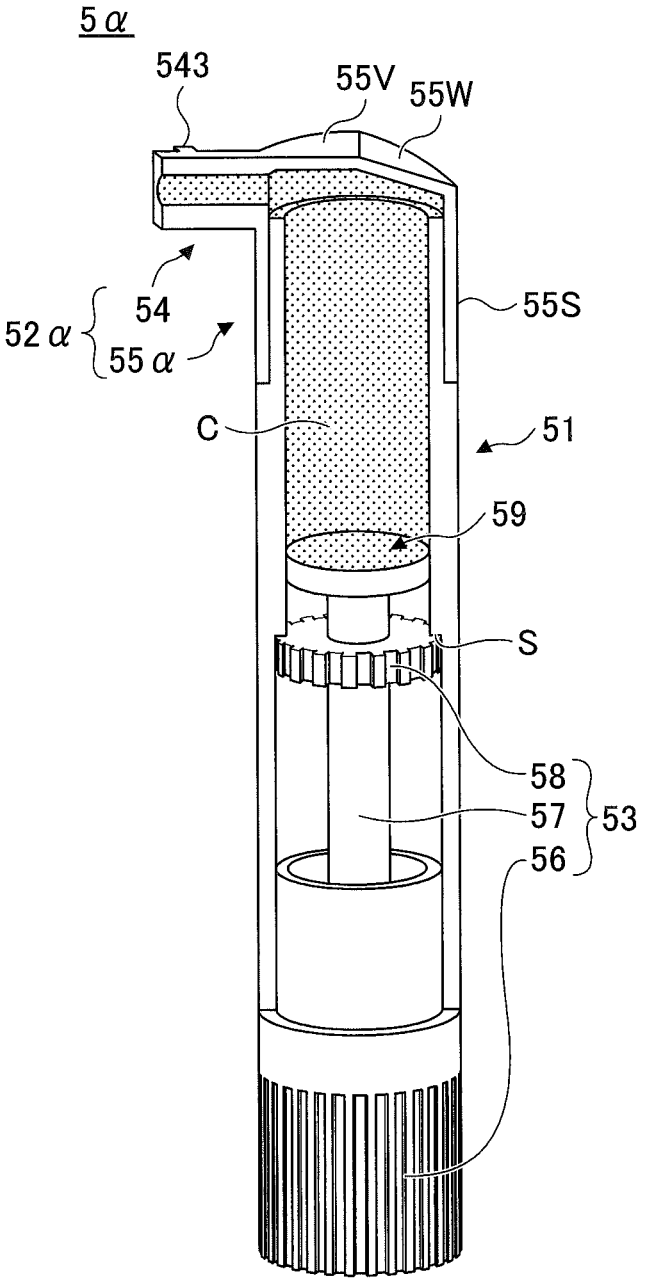
FIG. 4 is a view in partial cross section illustrating the feeding container according to a first modification of the present invention.

FIG. 4 illustrates a first modification of the feeding container. In FIG. 3B, the upper surface of the head section 52 has horizontal planar shape, however, the upper surface of the head section may be inclined.

In a feeding container 5α according to this modification, an upper surface of a head base 55α of a head section 52α is partially provided with a horizontal planar upper surface 55V, and a sloping surface 55W is provided at a portion separated from the nozzle 54.

According to this configuration, the nozzle 54 is integrally formed with the head base 55α, so that the upper surface of the nozzle 54 extends in the horizontal direction continuously from at least a portion (planar upper surface 55V) of the upper surface of the head base 55α in the head section 52α.

If the nozzle 54 is integrally formed with the head base 55α, the nozzle 54 does not need to extend in horizontal direction continuously from at least a portion (planar upper surface 55V) of the upper surface of the head base 55α.

<Second Modification>

Figure 5:
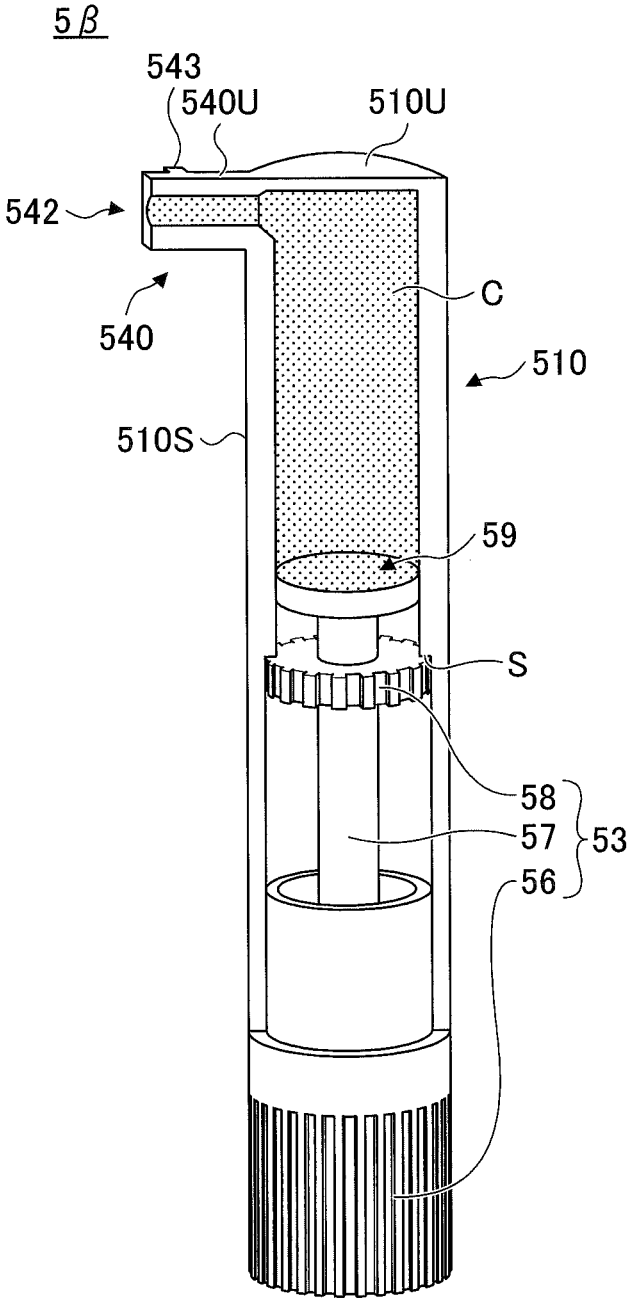
FIG. 5 is a view in partial cross section illustrating the feeding container according to a second modification of the present invention.

FIG. 5 illustrates a second modification of the feeding container. In the example illustrated in FIG. 1 through FIG. 4, the container body of the feeding container 5 is divided into the body cylinder 51 and the head section 52. However, portions other than the feeding section 53 may be integrally formed as the container body.

In this modification, the container body of a feeding container 5β is an accommodating chamber 510 having a side surface 510S and an upper surface 510U. The nozzle 540 is integrally formed with the accommodating chamber 510, so that an upper surface 540U of the nozzle 540 extends in the horizontal direction continuously from at least a portion of the upper surface 510U of the accommodating chamber 510.

FIG. 5 illustrates an example in which the upper surface 510U of the accommodating chamber 510 is flat, similar to FIG. 2A and FIG. 2B, however, in the accommodating chamber 510 in which the head section 52 and the body cylinder 51 are integrally formed, the upper surface separated from the nozzle may also be inclined, as illustrated in FIG. 4.

As illustrated in FIG. 1 through FIG. 4, if the head section 52 (52α) is configured independently of the body cylinder 51, the contents are filled from the top after the piston 59 and the feeding section 53 are attached with respect to the body cylinder 51, and the head section 52 (52α) thereafter closes the top.

On the other hand, if the head section and the body cylinder are integrally formed to configure the accommodating chamber 510, as in the modification illustrated in FIG. 5, the piston 59 and the feeding section 53 are attached with respect to the accommodating chamber 510 after the contents C are filled into the accommodating chamber 510 from the bottom.

The feeding containers 5, 5α, and 5β illustrated in FIG. 1 through FIG. 5 described above may be used independently. Furthermore, as illustrated in FIG. 6 and subsequent figures, the feeding containers 5, 5α, and 5β may be assembled into the discharge device as a cartridge which is a component of the discharge device.

<Push-Out Mechanism>

Figure 6:
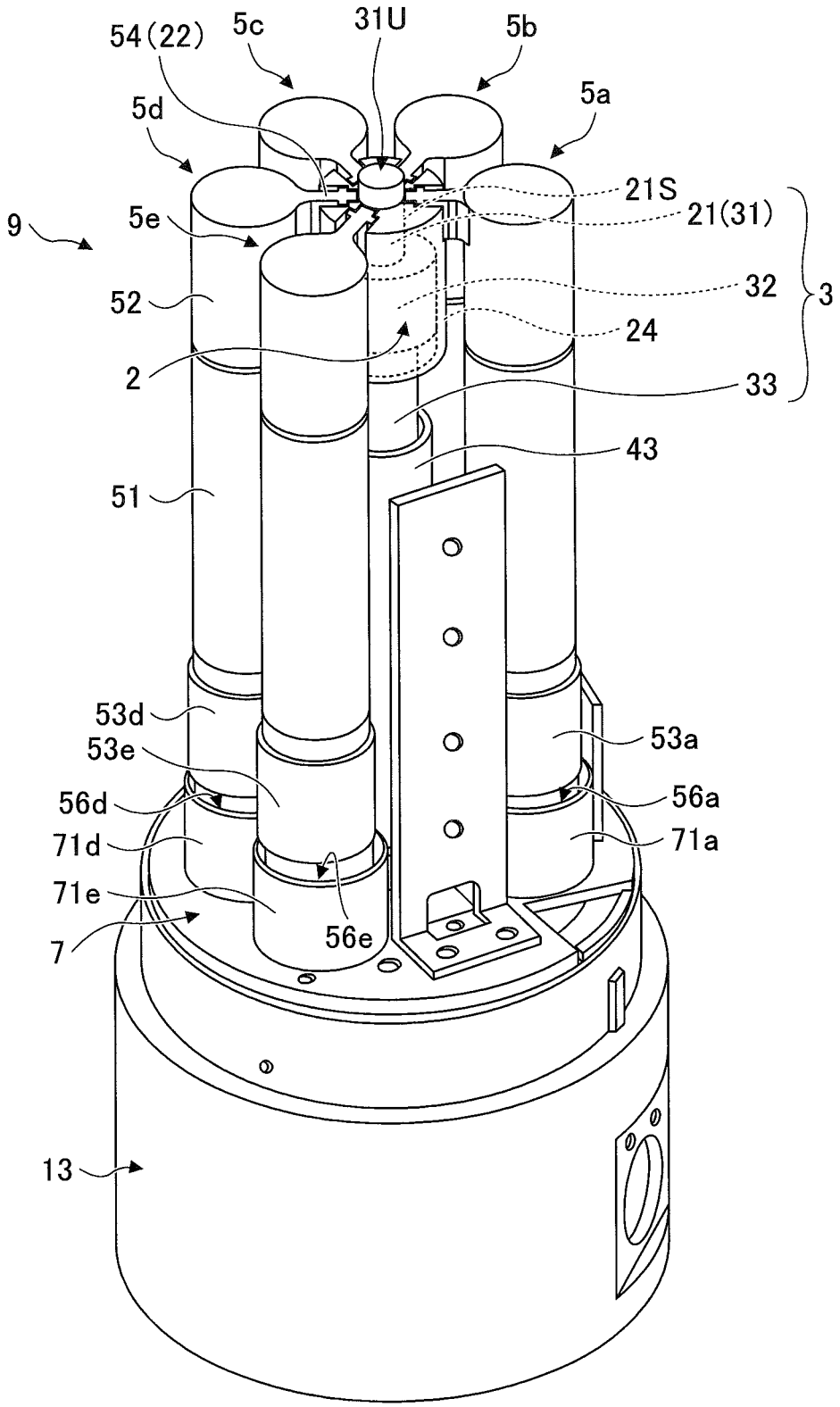
FIG. 6 is a perspective view of a push-out mechanism having a plurality of feeding containers according to the present invention.
Figure 7:
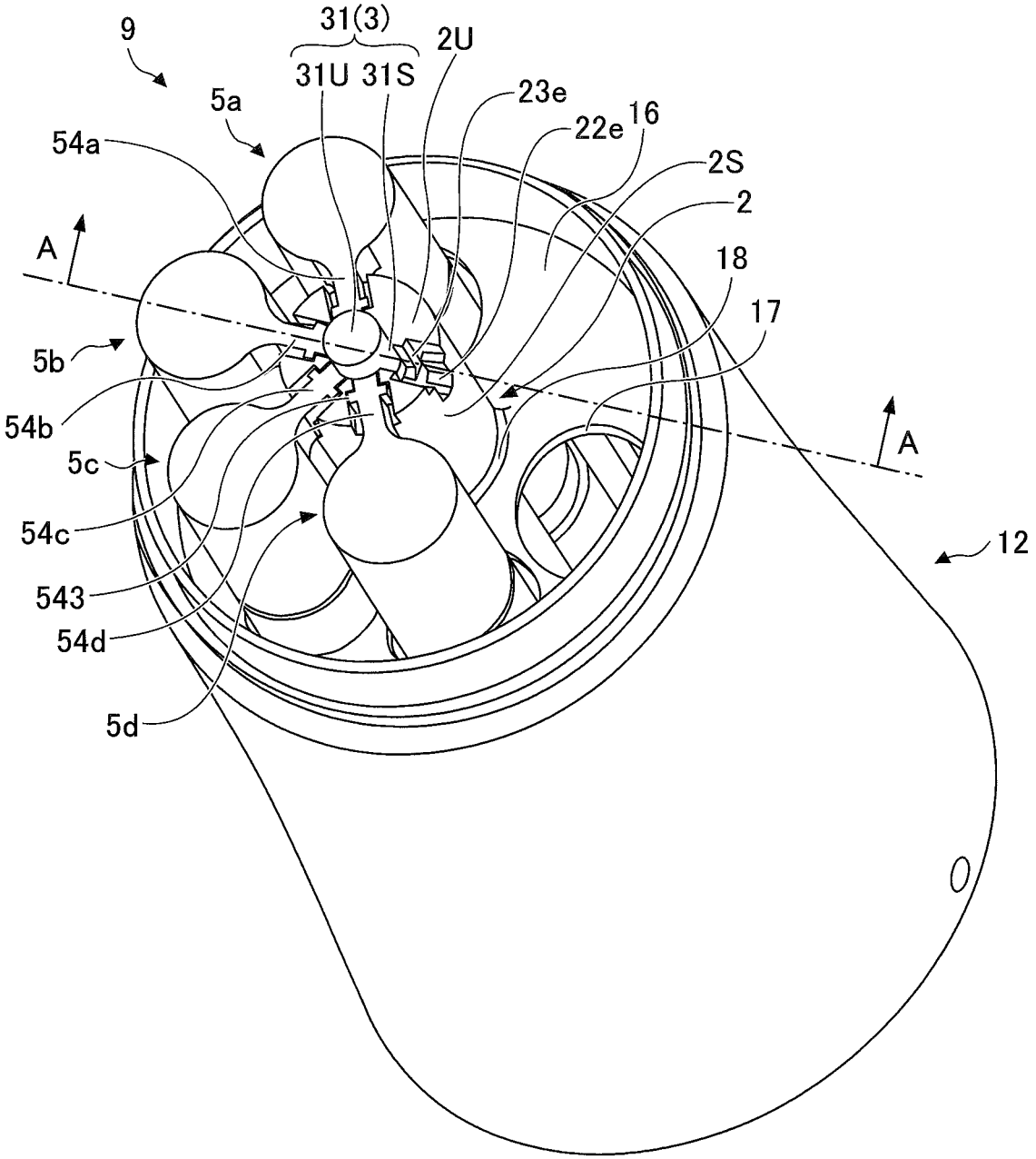
FIG. 7 is an enlarged view of an upper portion of the push-out mechanism illustrated in FIG. 6.
Figure 8:
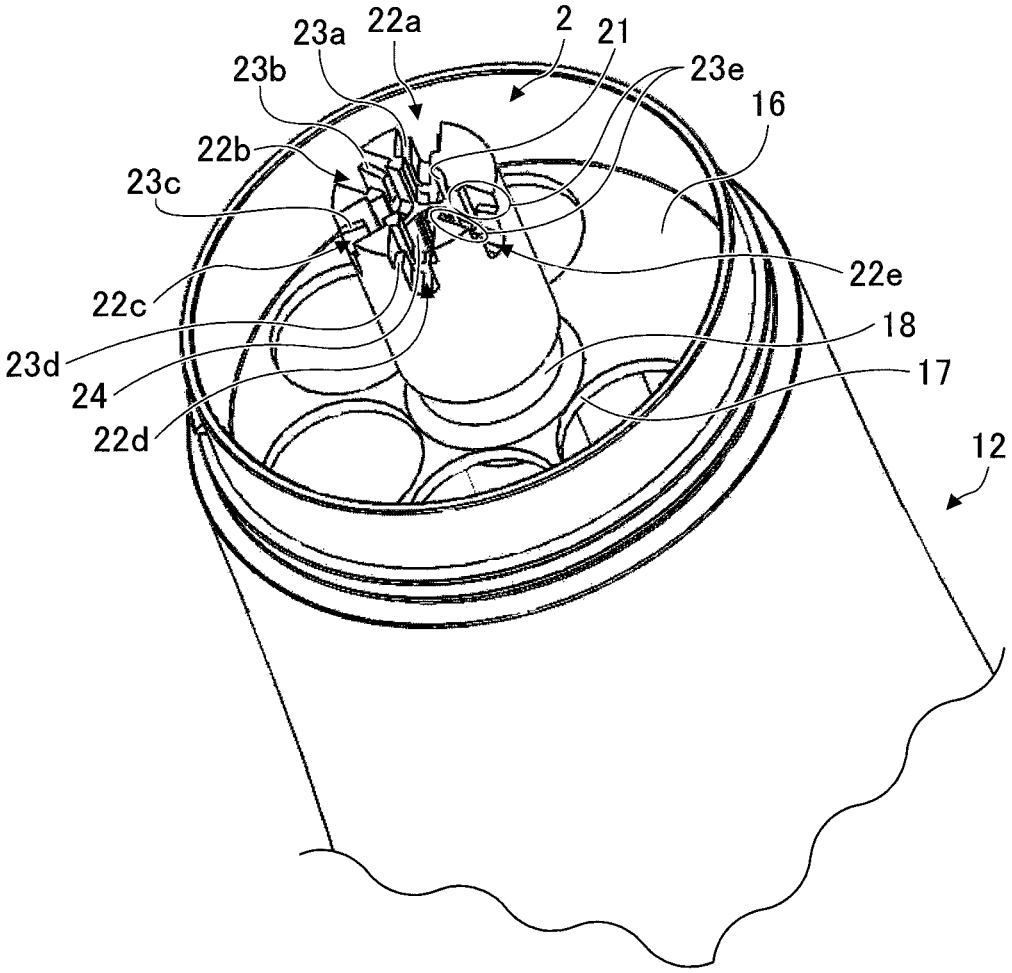
FIG. 8 is a diagram illustrating the push-out mechanism illustrated in FIG. 7 in a state where the feeding container and a center piston are removed.

FIG. 6 is a perspective view of a push-out mechanism 9 provided with a plurality of feeding containers according to the present invention. FIG. 7 is a top view illustrating an upper portion of the push-out mechanism illustrated in FIG. 6. FIG. 7 illustrates a state where one feeding container 5*e* is removed in the state illustrated in FIG. 6 where a cylindrical case 12 having a beam section 16 at an upper surface thereof is attached to the push-out mechanism. It is assumed that the feeding container 5*e* has the same configuration as the other feeding containers 5*a* through 5*d*. FIG. 8 is a diagram illustrating a state where the feeding containers and a center piston are removed from the push-out mechanism illustrated in FIG. 7.

The push-out mechanism 9 illustrated in FIG. 6 and FIG. 7 includes a plurality of feeding containers 5 (5*a* through 5*e*), and the columnar body 2 having a merging space 21 formed at a center thereof and extending in the up-and-down direction. In FIG. 6, the inside of the columnar body 2 is partially illustrated in a perspective by a dotted line. As illustrated in FIG. 6 and FIG. 7, nozzles 54*a* through 54*e* of the plurality of feeding containers 5*a* through 5*e* engage the columnar body 2.

As described above, in the head section 52, because the nozzle 54 and the head base 55 are integrally formed, it is possible to fix the entire head section 52 by fixing the portions of the nozzles 54 to the columnar body 2.

In addition, the head section 52 and the body cylinder 51 are fixed so as to be non-rotatable. For this reason, the nozzle 54 is fixed when rotating the operation cylinder 56, thereby enabling the rotation of the body cylinder 51 and the head section 52 to be restricted.

Moreover, the feeding containers 5*a* through 5*e* are attached above rotating shafts of motors, via a support plate 7 that is interposed between the feeding containers 5*a* through 5*e* and the rotating shafts. The support plate 7 is provided with cylindrical sections (fitting cylinders 71*a* through 71*e*) for restricting a lateral slip of the feeding containers, and the feeding containers 5*a* through 5*e* are fixed inside the cylindrical sections in a floating state with respect to the support plate 7.

The support plate 7 is attached to an upper portion of a bottom case 13. The support plate 7 is provided with a number of fitting cylinders (for example, fitting cylinders 71*a* through 71*e*), equal to the number of attachable feeding cylinders, that engage the operation cylinders 56 of the feeding containers 5*a* through 5*e*. The fitting cylinders 71*a* through 71*e* of the support plate 7 rotatably support the operation cylinders 56*a* through 56*e*. Although FIG. 6 illustrates configurations of the fitting cylinders 71*a*, 71*d*, and 71*e* and the operation cylinders 56*a*, 56*d*, and 56*e*, the fitting cylinders 71*b* and 71*c* and the operation cylinders 56*b* and 56*c* have the same configuration as the fitting cylinders 71*a*, 71*d*, and 71*e* and the operation cylinders 56*a*, 56*d*, and 56*e*. In the following description, suffixes "a" through "e" for identifying the plurality of feeding containers may be omitted.

Further, the center piston 3 is provided inside the merging space 21 of the columnar body 2. The center piston 3 is integral with a piston head section 31, a large diameter portion 32, and a piston rod 33 (refer to FIG. 9). The piston rod 33 engages an inner periphery of a rotation transmission cylinder 43, which is a portion of a drive section for moving the center piston 3 up and down.

The columnar body 2 has the merging space 21 formed at the center thereof and extending in the up-and-down direction (refer to FIG. 8). Further, a plurality of fitting grooves 22*a* through 22*e* are formed radially in an upper surface 2U of the columnar body 2 so as to penetrate the merging space 21 at the center and an outer surface 2S of the columnar body 2, so that the nozzles 54 of the plurality of feeding containers 5*a* through 5*e* can be fit from above.

Further, in this example, because the nozzle 54 of the feeding containers 5*a* through 5*e* has the external shape that extends in the horizontal direction in the rectangular column shape, except for the connecting portion which connects to the side surface 55S of the head base 55, the fitting grooves 22 of the columnar body 2 are angled rectangular grooves, as illustrated in FIG. 8. However, the nozzle 54 may have other external shapes if an insertion hole formed therein extends in the lateral direction. For example, the external shape of the nozzle 54 may be a rounded rectangular column shape with rounded corners, a lateral cylinder shape, a lateral semicircular column shape protruding downward, a lateral triangular column shape, or a lateral polygonal column shape. In this case, the fitting grooves 22 of the columnar body 2 may have a shape in accordance with the external shape of the nozzle 54, such as the shape of a chamfered U-groove, a groove having a semicircular cross section, a V-groove, or a groove having a lower half with a polygonal cross section.

In addition, referring to the portion from which the feeding container 5*e* illustrated in in FIG. 7 is removed, an engaging groove 23*e*, engageable with the projection 543 of the nozzle 54 and extending from the fitting groove 22*e*, is formed in the upper surface of the columnar body 2. Similarly, the fitting grooves 22*a* through 22*d* and the engaging grooves 23*a* through 23*e* are formed in the upper surface of the columnar body 2, at portions where the other feeding containers 5*a* through 5*d* engage.

The center piston 3 is provided inside the merging space 21. The center piston 3 is movable up and down inside the merging space 21.

FIG. 7 illustrates the center piston 3 in a state located at an upper position (push-out position). When the center piston 3 is located at the push-out position, each of the discharge holes 542*a* through 542*e* of the lateral nozzles 54*a* through 54*e* of the plurality of feeding containers 5*a* through 5*e* are closed by the center piston 3.

As illustrated in FIG. 6 and FIG. 7, when the center piston 3 is located at a first position, the center piston 3 protrudes above the upper surface 2U of the columnar body 2. Due to this protrusion, at the first position, the upper surface of the center piston is located approximately at the same position as the upper surface of the outer case.

Moreover, as illustrated in FIG. 7 and FIG. 8, the beam section 16 is formed near an upper end of the cylindrical case 12 surrounding the feeding containers 5*a* through 5*e*, and a hole 17 through which the feeding container 5*a* is inserted is formed in the beam section 16. In addition, a support cylinder 18 for supporting the columnar body 2 is provided at a center of the beam section 16.

As illustrated in FIG. 6 and FIG. 7, lower portions of the grooves 22 and 23 of the columnar body 2 form a tubular section 24 having a cylindrical shape with a diameter greater than the portion in close contact with the piston head section 31. The support cylinder 18 stands up in a tubular shape, and holds the tubular section 24 below the grooves 22 and 23 of the columnar body 2 from the inner periphery.

<Discharging Device>

Figure 9:
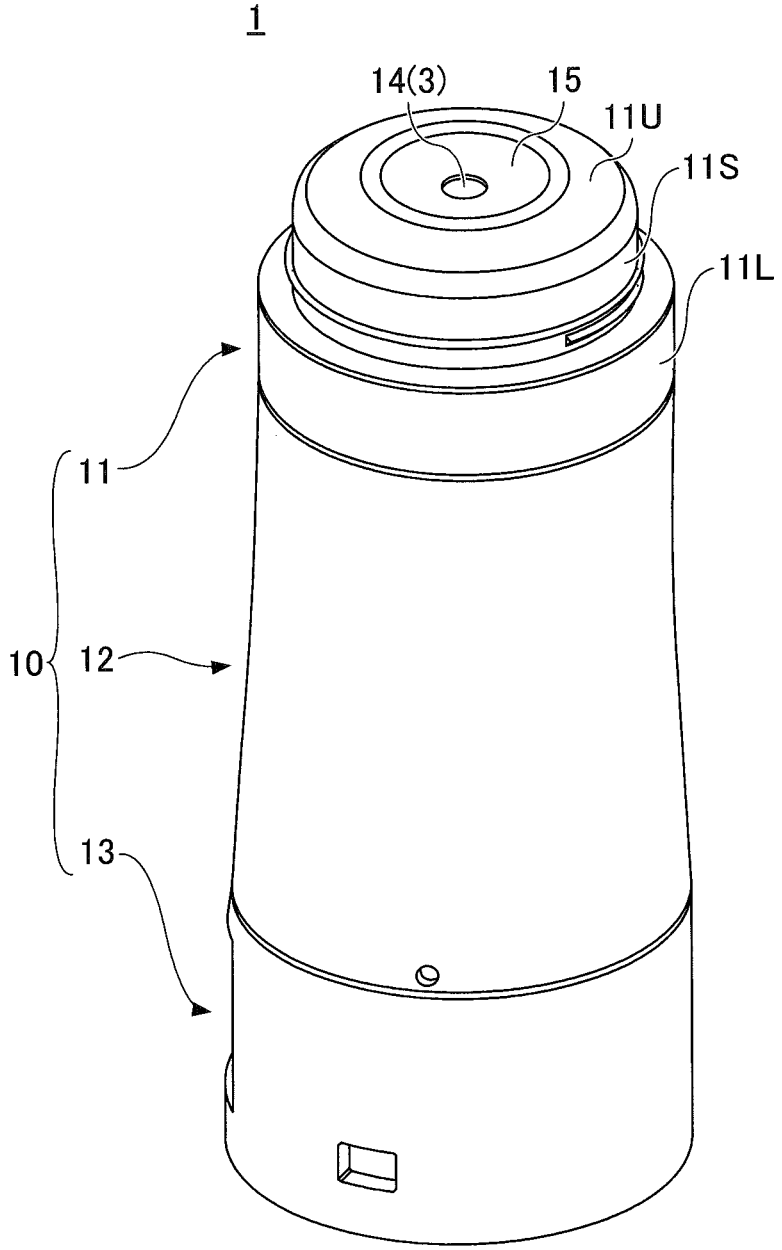
FIG. 9 is an external view of a discharge device according to a first embodiment having the push-out mechanism illustrated in FIG. 7.

FIG. 9 is an external view of the discharge device according to the first embodiment having the push-out mechanism illustrated in FIG. 6.

As illustrated in FIG. 9, a discharge device 1 according to this embodiment is surrounded by a device case 10 forming an outer container. The push-out mechanism 9 including the plurality of feeding containers 5*a* through 5*e*, the columnar body 2, and the center piston 3 illustrated in FIG. 6 are provided inside the device case 10. In the example illustrated in FIG. 9, the device case 10 includes a head case (upper case) 11, the cylindrical case 12, and the bottom case 13. Although the device case 10 has an approximately cylindrical shape in this example, the device case 10 may have a rectangular tube shape.

The head case 11 has a upper surface 11U which is the discharge surface formed with an opening 14. In addition, a side surface of the head case 11 has a shape corresponding to a combination of cylinders having different diameters combined in a stepped shape, and a threaded groove is formed in an outer periphery of a side surface portion 11S having a small diameter, so as to be screwable with respect to an inner periphery of the cap. A side surface portion 11L having a large diameter, is greater in diameter than the side surface portion 11S, by an amount corresponding to a thickness of the cap.

Moreover, a recess 15 which is recessed toward the inside in a mortar shape (bowl shape), is formed in the upper surface 11U, which is the discharge surface, around the opening 14.

In this embodiment, the opening 14 is provided so that the center piston 3 illustrated in FIG. 6 can be inserted into the opening 14. For this reason, FIG. 9 illustrates an example in which a diameter of a periphery of the center piston 3, provided inside the merging space 21 communicating with the opening 14, is the same as a diameter of the opening 14.

In the discharge device 1, the feeding containers 5*a* through 5*e* are removable and replaceable cartridges.

<Internal Cross Section of Discharge Device>

Figure 10A:
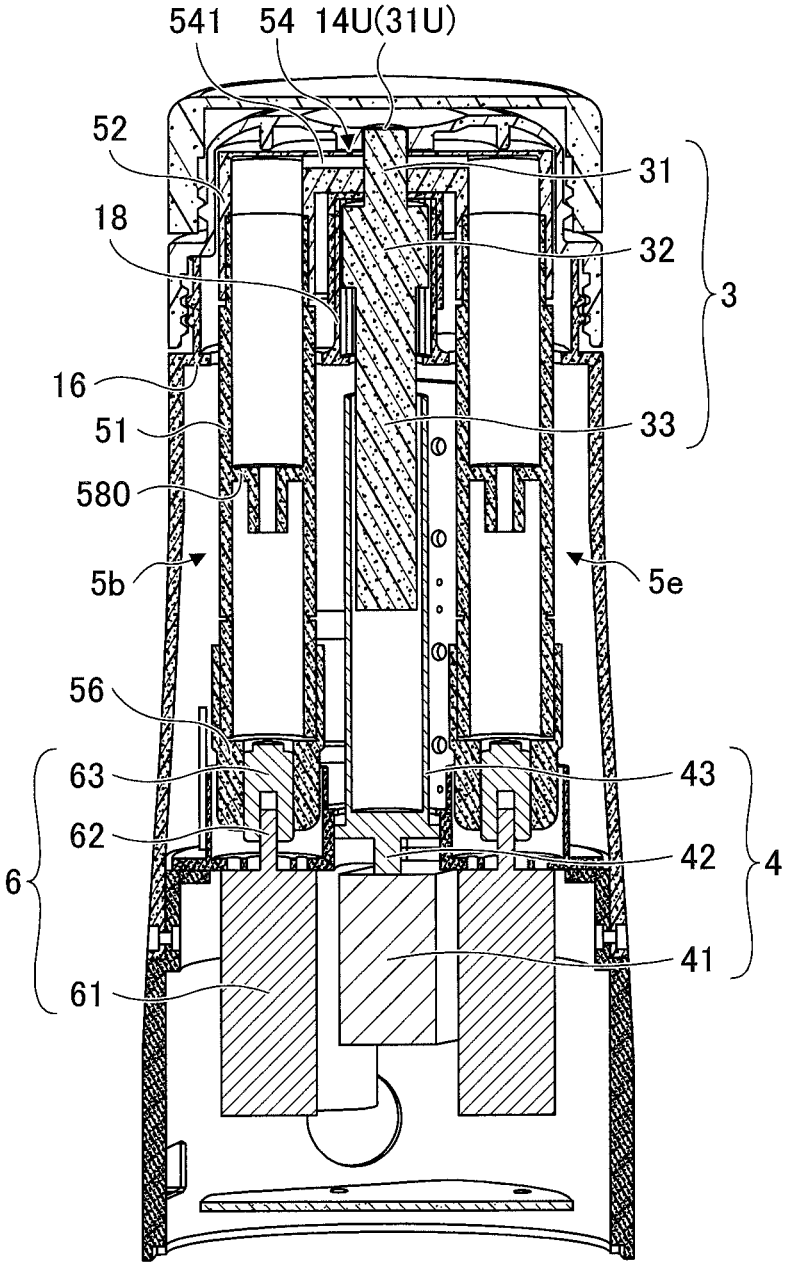
FIG. 10A is an example of a cross sectional view of the discharge device illustrated in FIG. 9, illustrating a state where the center piston is located at a first position.
Figure 10B:
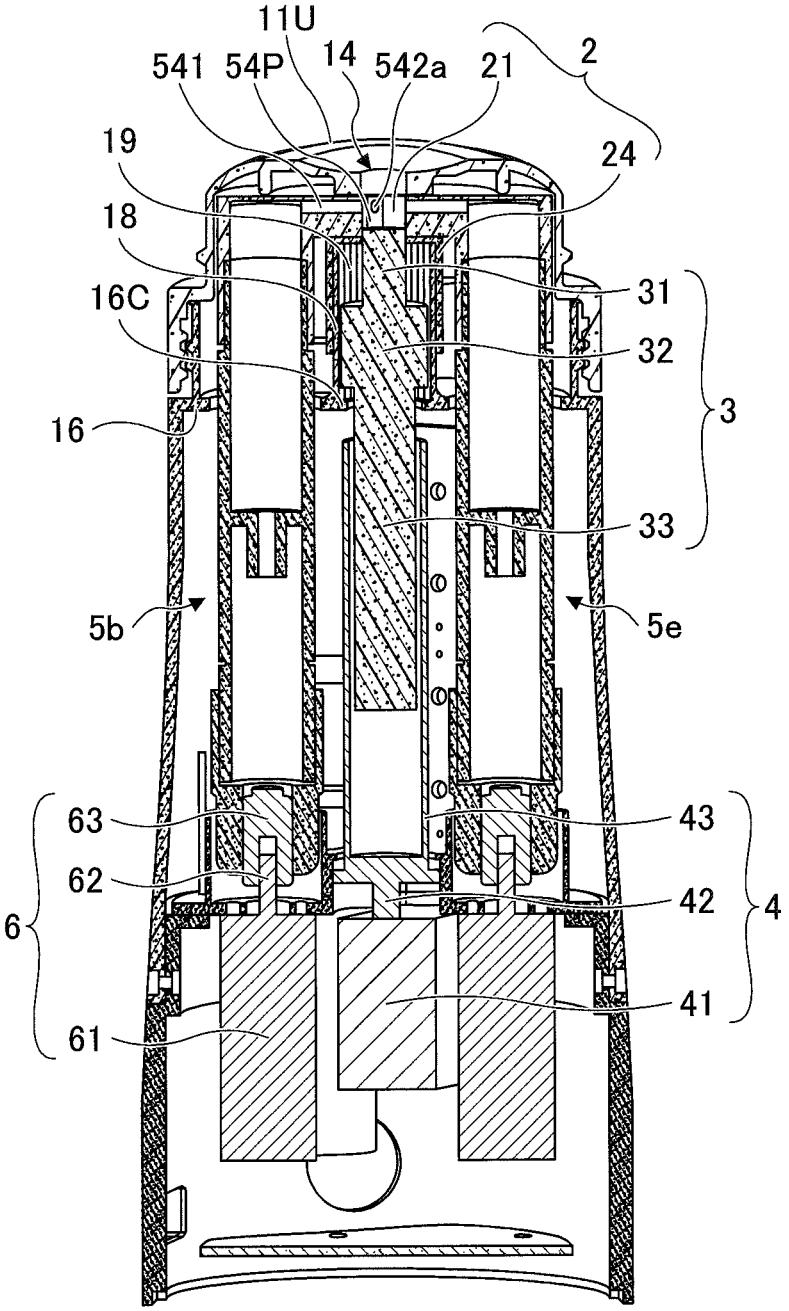
FIG. 10B is an example of the cross sectional view of the discharge device illustrated in FIG. 9, illustrating a state where the center piston is located at a second position.

FIG. 10A and FIG. 10B are cross sectional views of the discharge device 1 illustrated in FIG. 9. FIG. 10A is a diagram illustrating a state, such as a standby state, for example, where the center piston 3 is located at the first position, and FIG. 10B is a diagram illustrating a state where the center piston 3 is located at a second position. FIG. 10A and FIG. 10B illustrate cross sections of the states where the discharge device illustrated in FIG. 9 is cut along a line A-A in FIG. 7.

As illustrated in FIG. 10B, the columnar body 2 formed with the merging space 21 is provided inside the device case 10, and the center piston 3 is arranged in the merging space 21.

The center piston 3 fits on the inner side of an inner wall 21S (refer to FIG. 6) of the merging space 21, and is movable between the first position illustrated in FIG. 10A, and the second position illustrated in FIG. 10B separated more from the opening 14 than the first position. The piston head section 31 of the center piston 3 illustrated in FIG. 6 through FIG. 9 has a cylindrical shape or an elliptical cylinder shape having a side surface 31S which can make close contact with the inner wall 21S at the side surface of the merging space 21.

Further, because FIG. 10A and FIG. 10B are longitudinal cross sectional views, two feeding containers 5*b* and 5*e* in the front are visible in these figures, however, a plurality of feeding containers are provided in the front and also in the rear, and thus, five feeding containers 5*a*, 5*b*, 5*c*, 5*d*, and 5*e* are provided in the discharge device 1, similar to FIG. 6.

When the piston 3 is located at the second position illustrated in FIG. 10B, the discharge hole 542 of the nozzle 54 communicates with the merging space 21 (assumes a communication state), and the contents can flow into the merging space 21 from the plurality of discharge holes 542*a* through 542*e*. For example, FIG. 10B illustrates a state where the discharge hole 542*a* of the feeding container 5*a* arranged at the rear of the feeding container 5*b* is open. In this state, the contents from the plurality of feeding containers 5*a* through 5*e* are discharged from the plurality of discharge holes 542*a* through 542*e*, via the plurality of nozzles 54*a* through 54*e*, and merge in the merging space 21.

When the center piston 3 is located at the first position illustrated in FIG. 10A, the discharge holes 542*a* through 542*e* of the nozzles 54*a* through 54*e* are closed by the head section 31 of the center piston 3 at the merging space 21.

In the discharge device 1, the center piston 3 is located at the first position illustrated in FIG. 10A after the discharge and in the standby state. In this embodiment, a top surface 31U of the piston head section 31 is approximately at the same as an opening surface 14U of the opening 14 when the center piston 3 is located at the first position, and as illustrated in FIG. 6, the center piston 3 is at a protruding position with respect to the columnar body 2.

Furthermore, the discharge device 1 is provided with push-out sections (rotation drive sections) 6*a* through 6*e* below the feeding containers 5*a* through 5*e*. In the feeding containers 5*b* and 5*e* illustrated in FIG. 10A and FIG. 10B, the shape of a rotation restricting section 580 integrated with the step S is different from that of FIG. 2, however, either one of these configurations may be used. Moreover, illustration of constituent elements such as the piston or the like inside the feeding container 5 is omitted in FIG. 10A and FIG. 10B.

In addition, the body cylinder 51 and the head section 52 of the feeding container 5 engage each other so as not to rotate, and the nozzle 54 of the head section 52 engages the fitting groove 22 of the columnar body 2, thereby restricting the rotation of the head section 52 and the body cylinder 51 in a circumferential direction and fixing the head section 52 and the body cylinder 51.

As illustrated in FIG. 10A, the push-out section 6 includes a drive motor 61, a rotating shaft 62, and a transmission shaft 63.

As illustrated in FIG. 10A, the transmission shaft 63 is provided in a breech mechanism portion on a lower end of the operation cylinder 56. The rotating shaft (output shaft) 62 of the drive motor 61 is connected to the transmission shaft 63.

According to this example of the configuration, when the drive motor 61 of the push-out section 6 drives the rotating shaft 62 to rotate, a rotary force of the rotating shaft 62 is transmitted to the operation cylinder 56 via the transmission shaft 63, and the operation cylinder 56 rotates relative to the body cylinder 51 which is fixed. As a result, the piston 59 (refer to FIG. 2B) rises, and the contents C are pushed out from the discharge hole 542 (542*a* of FIG. 10B) of the nozzle 54 extending in the horizontal direction toward the merging space 21 at the center portion.

FIG. 10A illustrates an example in which the transmission shaft 63, which is thinner than the operation cylinder 56, engages the lower end of the operation cylinder 56, to transmit the rotary force from the center portion. However, a member for transmitting the rotary force may be provided on the outer periphery of the operation cylinder 56, to transmit the rotary force from the outer periphery of the operation cylinder 56 to the operation cylinder 56.

Next, an elevating operation of the center piston 3 will be described. The center piston 3 is driven to move by a piston drive section 4 provided at a lower portion of the center piston 3.

This example illustrates a case where the discharge surface formed with the opening 14 is the upper surface 11U of the device case 10, and the center piston 3 can move up and down between the upper first position illustrated in FIG. 10A and the lower second position illustrated in FIG. 10B.

As illustrated in FIG. 6, FIG. 10A, and FIG. 10B, the center piston 3 is elongated along the up-and-down direction, and includes the head section 31 in contact with the columnar body 2, the large diameter portion 32 having a diameter greater than the head section 31, and the piston rod 33 provided on a lower end of the large diameter portion 32. The head section 31 of the center piston 3 moves up and down inside the merging space 21 formed in the columnar body 2.

In the columnar body 2, the tubular section 24 having the diameter greater than the merging space 21 which is the opening provided on an upper side as illustrated in FIG. 6, is provided on a lower side of the grooves 22 and 23 visible in FIG. 7 and FIG. 8, and this tubular section 24 is supported from the inner periphery thereof by the support cylinder 18 provided in the beam section 16.

Projections (linear ribs) 19 extending in the up-and-down direction as illustrated in FIG. 10B are provided on the inner periphery of the support cylinder 18.

In addition, a member which restricts the rotation of the center piston 3 by a projection, a groove, a polygonal column shape, or the like, is provided on the outer periphery of the large diameter portion 32 of the center piston 3.

The beam section 16 extends in the horizontal direction to the inside of the support cylinder 18, so that the extended portion becomes the retaining portion 16C.

The piston rod 33 on a lower side of the large diameter portion 32 of the center piston 3 has a diameter smaller than the large diameter portion 32. For example, the piston rod 33 may have a male screw shape including a plurality of projections at the lower end thereof.

In the example illustrated in FIG. 10A and FIG. 10B, the piston drive section 4 includes a piston motor 41 which is a rotating motor (positioning gear motor) that generates a rotary force, a rotating shaft 42, and the rotation transmission cylinder 43.

More particularly, in this example of the configuration, the piston rod 33 having the male screw shape including the plurality of projections, is formed on the lower end of the center piston 3 separated from the opening 14. The rotation transmission cylinder 43, connected to the rotating shaft 42, has a female screw shape including a spiral groove formed in the inner periphery thereof, and is screwed onto the piston rod 33.

The rotating shaft 42 and the rotation transmission cylinder 43 are rotation transmitting bodies for transmitting the rotary force of the piston motor 41, which is the rotation motor, as a moving force for the center piston 3.

In this case, because the rotation of the large diameter portion 32 is restricted by the projections 19 of the support cylinder 18, the large diameter portion 32 limits the center piston 3 from rotating together with the rotation transmission cylinder 43 when the rotation transmission cylinder 43 rotates, and transmits the rotary force of the piston motor 41 as the moving force in forward and backward directions of the center piston 3.

In the example illustrated in FIG. 10A and FIG. 10B, the piston rod 33 having the male screw shape is provided at the lower portion of the center piston 3, and the rotation transmission cylinder 43 has the female screw shape, however, the locations of the male and female screw shapes may be reversed as long as the piston rod 33 and the rotation transmission cylinder 43 can be screwed relative to each other. For example, a spiral groove may be formed in the piston rod 33, and projections may be formed on an upper end of the rotation transmission cylinder 43, so that the projections on the upper end of the rotation transmission cylinder 43 engage the spiral groove of the piston rod 33. Alternatively, a cylindrical engaging portion may be provided at a lower end of the piston, and a rotation transmission body may be configured to engage an inner periphery of the cylindrical engaging portion, that is, to reverse the arrangement of the engagement between the cylindrical engaging portion and the shaft.

Moreover, in this embodiment, the periphery of the center piston 3 and the opening 14 in the upper surface of the head case 11 have diameters that are approximately the same, as illustrated in FIG. 10A. When the center piston 3 is located at the first position, the surface (opening surface) 14U at a lowest portion of the recess 15 in the upper surface 11U, which is the discharge surface, and the top surface (upper surface in this example) 31U of the piston head section 31, have heights that are approximately the same.

For this reason, the plurality of the contents, discharged from the discharge holes 542*a* through 542*e* to the merging space 21, are pushed out by the center piston 3, so that all of the contents can be pushed out of the discharge device 1.

More particularly, the contents make contact with and ride on the top surface 31U of the piston head section 31 in the merging space 21, and are delivered to the position of the upper surface 11U, which is the discharge surface of the device case 10, as the center piston 3 rises.

For this reason, during a discharge operation, the contents make contact with the inner wall 21S (refer to FIG. 6) of the merging space 21, the discharge surface 54P of the nozzle 54, the inner wall of the opening 14 of the head case 11, and the top surface 31U of the piston head section 31. Because the inner wall 21S of the merging space 21, the discharge surface 54P of the nozzle 54, the inner wall of the opening 14 of the head case 11, and the side surface 31S of the piston head section 31 are in close proximity to one another, and thus, even if the contents were to adhere to the inner wall 21S and the discharge surface 54P when flowing into the merging space 21, the adhered contents are also accumulated on the top surface 31U of the piston head section 31 as the center piston 3 moves from the second position to the first position, thereby pushing out the contents outside to the position of the upper surface 11U of the head case 11.

For this reason, after the discharge operation, no contents remain inside the merging space 21, and thus, it becomes unnecessary to clean the inside of the discharge device 1 after the discharge operation.

In addition, because the center piston 3 remains at the first position illustrated in FIG. 10A after the discharge operation, the discharge hole 542 of the nozzle 54 and the merging space 21 are closed to a shut state by the center piston 3, thereby maintaining a state where the plurality of kinds of contents are prevented from flowing into the merging space 21.

Accordingly, even without cleaning the inside of the container of the discharge device according to the present invention, none of the contents, foreign particles, or the like accumulate inside the merging space 21. Hence, even in a case where a mixing ratio is changed the next time the discharge device is used, the discharge operation can be performed without having to consider the state of the mixing ratio of the contents during the previous discharge operation, nor cleaning the discharge device. In addition, because the plurality of holes are effectively blocked during times other than the discharge operation, it is possible to prevent volatilization of the contents.

Further, according to this embodiment, the diameter of the opening 14 in the upper surface 11U is continuous with an inner diameter of a sidewall forming the merging space 21, and is approximately the same size as the inner diameter of the sidewall forming the merging space 21. In other words, because the opening 14 is configured with a dimension which enables close contact with the periphery of the center piston 3, the contents riding on the top surface 31U of the piston head section 31 are pushed out while maintaining the same area as when the contents flow onto the top surface 31U, without being subjected to a pressure from the side.

According to this configuration, the movement of the contents flowing from the opening 14 into the merging space 21 via the discharge holes 542*a* through 542*e*, and the movement of the center piston 3, can all be visibly confirmed by the user, and the user can enjoy watching the discharge operation of the discharge device 1.

At an outer peripheral surface (side surface) of the center piston 3, portions making contact with the discharge holes 542*a* through 542*e* when the center piston 3 is located at the first position, may be provided with a seal portion which improves sealing for blocking the discharge holes.

For example, in the example illustrated in FIG. 10A and FIG. 10B, the portions of the center piston 3 other than the seal portion may be made of High Density Polyethylene (HDPE) or polypropylene (PP).

Further, the seal portion of the center piston 3 may be made of a soft material such as nitrile rubber (NBR), silicone rubber, thermoplastic elastomer (olefin and styrene), or the like.

<Customized Discharge System>

Figure 11:
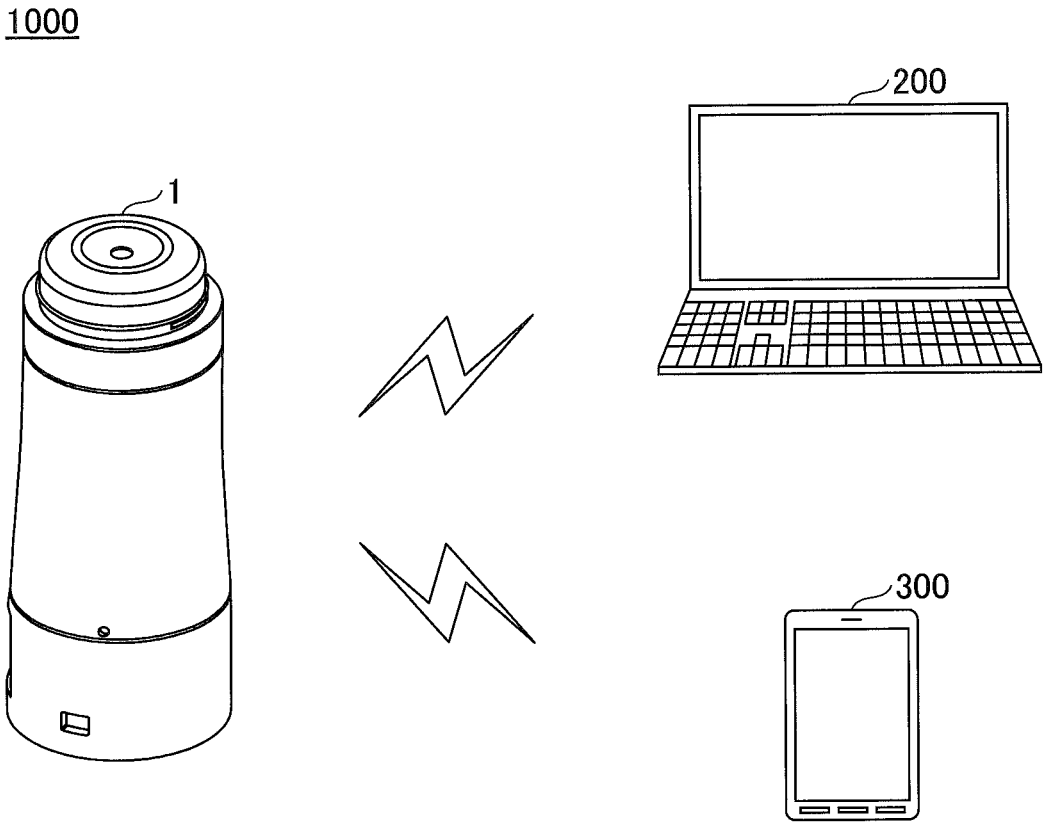
FIG. 11 is a schematic diagram illustrating a customized discharge system including the discharge device according to the first embodiment of the present invention.

FIG. 11 is a schematic diagram illustrating a customized discharge system including the discharge device according to the present invention.

In a customized discharge system 1000 including the discharge device 1 according to the present invention, an instruction on information related to a formulation of the plurality of contents may be received from an information processing terminal, which is an external device communicable with the discharge device 1 via a network.

In this embodiment, it is assumed that the discharge device 1 and information processing terminals 200 and 300 are combined to form the customized discharge system 1000.

According to this embodiment, a communication section 97 (refer to FIG. 12) is provided in a part of a control board of the discharge device 1, and this communication section 97 is communicable with a computer 200 or a smartphone 300, which is an information processing terminal. The customized discharge system 1000 is configured to include the discharge device 1, and at least one of the computer 200 and the smartphone 300.

The information processing terminals 200 and 300 can have an instruction accepting function for receiving the instruction on the information related to the formulation of the plurality of contents of the discharge device 1, by downloading an application program in advance or the like, for example.

Accordingly, the user inputs information related to the discharge amount (formulation) of the discharge device to the information processing terminals 200 and 300.

[Control Block of Customized Discharge System]

Figure 12:
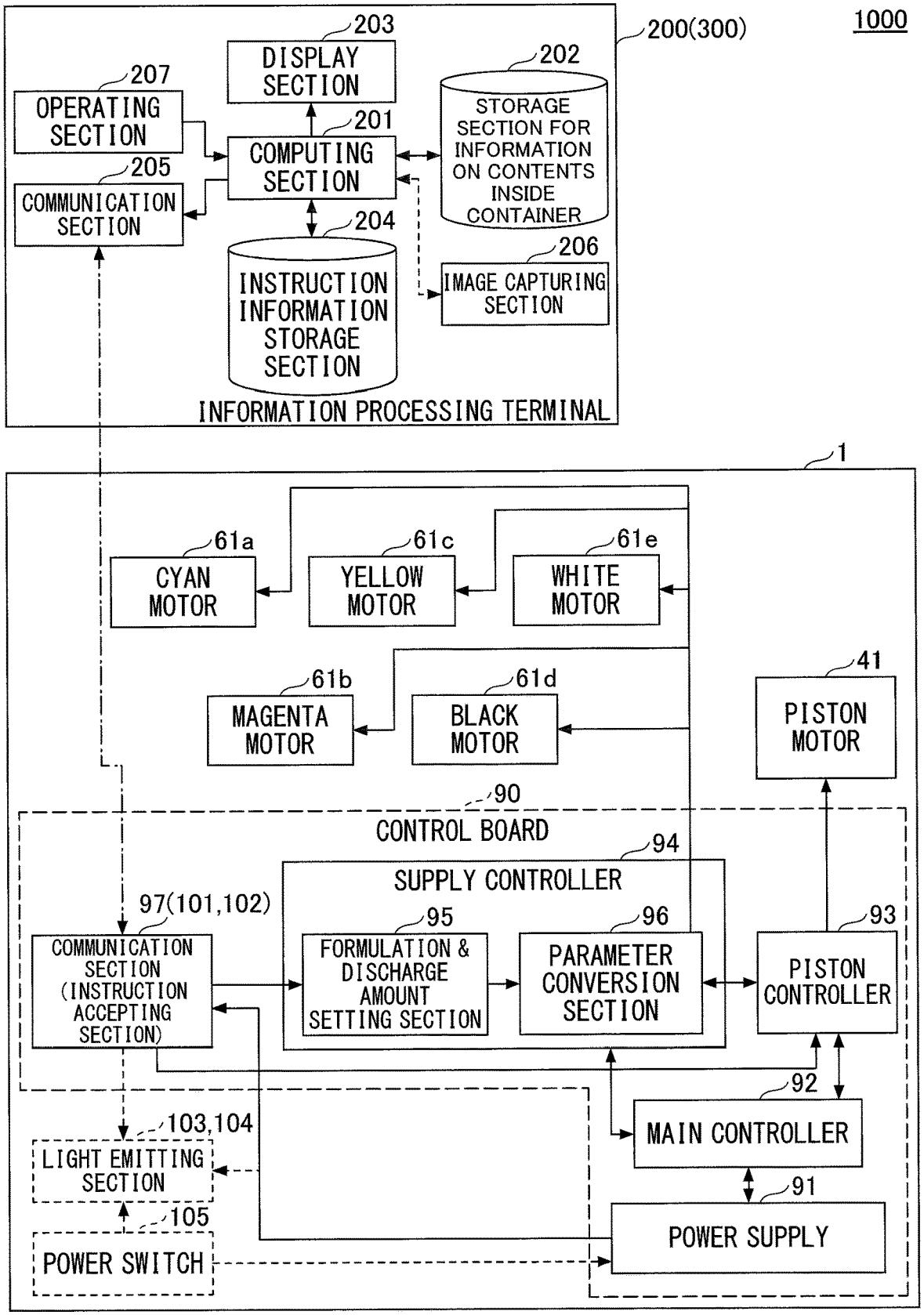
FIG. 12 is a control block diagram of the customized discharge system illustrated in FIG. 11.

FIG. 12 is a functional control block diagram of the customized discharge system 1000 illustrated in FIG. 11.

The discharge device 1, included in the customized discharge system 1000, is provided with a communication section 97 which functions as an instruction accepting section that receives information transmitted from the external device (information processing terminals 200 and 300) communicable with the customized discharge system 1000 via the network.

An example of the configuration of the discharge device 1 in which the plurality of contents are cosmetic materials having five different colors will be described. In this example, the cosmetic materials having the five colors are cyan, magenta, yellow, black, and white cosmetic materials used for point makeup, for example.

The piston motor 41 for driving the center piston 3 is provided as a part of the piston drive section 4. In addition, a cyan motor 61*a*, a magenta motor 61*b*, a yellow motor 61*c*, a black motor 61*d*, and a white motor 61*e*, which are drive motors of the push-out section, are provided to push out the contents from each of the feeding containers 5*a* through 5*e*.

The control board 90 forming a control device includes a power supply 91, a main controller 92, a piston controller 93, and a supply controller 94.

The piston controller 93 drives the piston motor 41 for raising and lowering the center piston 3.

The supply controller 94 sets supply amounts of the plurality of contents, to be supplied and flow into the merging space 21, from the plurality of feeding containers via a plurality of supply passages and the plurality of discharge holes. The supply controller 94 includes a formulation and discharge amount setting section 95, and a parameter conversion section 96.

The formulation and discharge amount setting section 95 sets a formulation ratio of the plurality of contents, based on the instruction on the information related to the formulation, and sets the supply amount of each of the plurality of contents.

The parameter conversion section 96 converts the set supply amounts of the plurality of contents into parameters. The supply amounts (push-out and delivering amount) of the plurality of contents may be adjusted by controlling a rotating amount and an operation time of each of the color motors 61*a* through 61*e*, which are the drive sections, as the parameters, for example. Then, based on the set parameters, power is supplied to each of the color motors 61*a* through 61*e*, which are push-out and delivering means.

The main controller 92 adjusts timings for operating the supply controller 94 and the piston controller 93.

The piston controller 93 promptly supplies the power to the piston motor 41 after receiving an instruction from an operating section 101 of the information processing terminal 200 or 300, to move the center piston 3 from the first position to the second position.

The supply controller 94 drives the motors 61*a* through 61*e*, which are driving sections, at timings after the center piston 3 moves to the second position, to supply the plurality of set contents into the merging space 21.

The piston controller 93 supplies the power to the piston motor 41 at a timing after all of the plurality of set contents are supplied into the merging space 21, to move the center piston 3 from the second position to the first position.

Although FIG. 11 only illustrates the external view of the discharge device 1, the internal configuration of this embodiment is the same as in FIG. 6 through FIG. 9.

The discharge device 1 sets the supply amount of each of the plurality of contents flowing into the discharge space from the plurality of feeding containers via the discharge hole 542 of the lateral nozzle 54, based on the instruction on the information related to the formulation, input to the information processing terminal 200 or 300.

FIG. 11 illustrates an example in which no operating section is provided in the discharge device 1 that is communicable, however, in addition to receiving the instruction from the information processing terminals 200 and 300, an operating section may be further provided in the discharge device that is communicable, so as to be manually operable. Functions of the operating sections 101 and 102, the light emitting sections 103 and 104, and a power switch 105 illustrated by a dotted line, will be described in detail with reference to FIG. 13.

The information processing terminal 200 includes a computing section 201, a storage section 202 for information on contents inside container, a display section 203, an instruction information storage section 204, and a communication section 205.

When the user sets the discharge amount of the discharge device 1 using the information processing terminal 200 or 300, the ratio of the contents and the discharge amounts may be set directly at the discharge device 1. Alternatively, an operating section 207 of the information processing terminal 200 or 300 may be used to make a selection from information suitably classified according to an application program (information on contents inside containers) stored in the information processing terminal 200 or 300; based on information after completion.

When making the selection based on the information after the completion, the information processing terminal 200 or 300 is configured to prestore the ratios (formulations) of the discharge amounts of each of the contents, and completed tones and textures felt by skin after mixing, in the storage section 202 for information on contents inside container. Then, the information on the tones and the textures felt by the skin after mixing the contents with predetermined ratios, is displayed on the display section 203, to urge the user to select the information, based on the information on the tones and the textures felt by the skin after the mixing. By making the information selectable, it is possible to reduce a load on the user to consider the mixing ratio of the contents.

For example, when making a base makeup material with the contents (cosmetic materials) having different colors as the contents of the discharge device 1, the information processing terminal 200 displays a plurality of model colors, such as ochre, beige, and ivory skin colors or the like after the mixing, for example, in a step-by-step manner on the display section 203. Then, when the user selects a color on the screen, the computing section 201 computes the discharge formulation according to the image display of the selected color. The communication section 205 transmits the computed information to the discharge device 1, and the discharge device 1 causes the contents of the plurality of different colors to be discharged simultaneously at a predetermined mixing ratio based on the information, and a predetermined completed color is obtained when the user mixes the contents.

In addition, when making a cosmetic material for partial makeup with the contents (cosmetic materials) having different colors, colors such as lucent (transparent), white, pink, red, purple, blue, green, brown, or the like, for example, may be selected in a step-by-step manner for each color. In this case, the information processing terminal 200 displays the model color of the tone on the display section 203, and when a color is selected on the screen, the computing section 201 computes the discharge formulation according to the image display of the selected color.

When making the cosmetic material for partial makeup by mixing the contents described above, it is possible to enjoy a plurality of tone by a single discharge device by changing the discharging colors, and it is possible to use the single discharge device for multiple applications (for example, eye gloss and a lip gloss, highlight, shadow, and a cheek) by changing the color setting.

Even if the selection from the information after the completion is possible as described above, a method in which the user considers the ratio and directly inputs the ratio may be left as an option.

In the examples described above, the user selects the mixing ratio directly or from the completed information. However, an optimum color formulation may be set automatically by the computing section 201 according to a result of capturing the skin by a camera. For example, an image capturing section (camera) 206 may be built into the smartphone 300 illustrated in FIG. 12, or a camera may be provided on the computer 200, and the skin may be captured by the image capturing section 206, so that the completed color can be set according to the color of the skin in the captured photograph image.

For example, in the case of the base makeup, the computing section 201 of the smartphone 300 may automatically select the color according to the skin color, compute the mixing ratio, and set the mixing ratio, so as to discharge the set color by mixing the contents from the discharge device 1 with a predetermined mixing ratio. Alternatively, in the case of the partial makeup, the computing section 201 of the smartphone 300 may automatically select a tone of the makeup color suitable for the skin color, and display the selected tone on the display section 203 as a selectable "recommendation".

<Operation Procedure>

Next, an operation procedure of the customized discharge system 1000 according to the present invention will be described.

Figure 13:
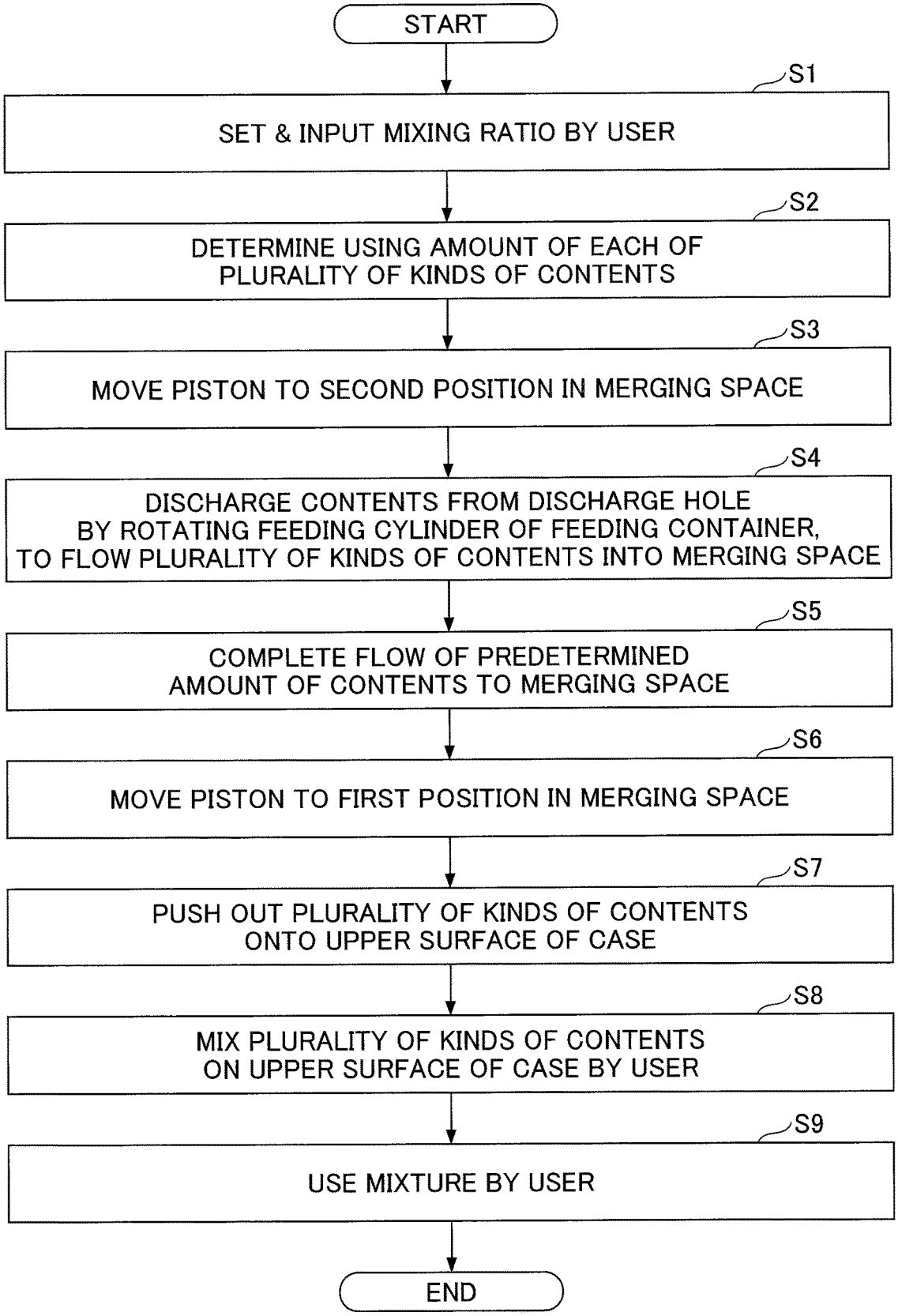
FIG. 13 is a flow chart of an operation when using the customized discharge system illustrated in FIG. 11.

FIG. 13 is a flow chart of an operation when using the discharge device according to the present invention. It is assumed that the procedure of the flow chart is preset by a program stored in the control board 90 of the discharge device 1 or the information processing terminal 200 (300).

In step S1 illustrated in FIG. 13, the user sets the mixing ratio of the contents, and inputs the set mixing ratio from the operating section 207. According to this embodiment, the user inputs the information from the information processing terminal connected via the network, but as will be described later, the operating sections 101 and 102 may be provided in the discharge device.

In step S2, the computing section 201 of the information processing terminal 200 (300), or the supply controller 94 of the discharge device 1, determines using amounts (discharge amounts) of the plurality of kinds of contents, based on the set mixing ratio.

In step S3, the center piston 3 is moved from the first position to the second position in the merging space 21. In other words, the center piston 3 moves downward inside the merging space 21 by electronic control, from the position blocking the discharge holes 542*a* through 542*e* of the nozzles 54 engaging the grooves 22 and 23 of the columnar body 2, to the position where an upper end of the center piston 3 releases the discharge holes 542*a* through 542*e*.

After step S3, in step S4, the drive motor 61 of the push-out section 6 is driven to raise the piston 59 of the feeding container 5, to push out the contents from the discharge holes 542 of the nozzles 54.

In a state immediately after the start of use, the contents fed during the previous use already reaches the nozzle passage 541 of the head section 52. For this reason, at times other than immediately after the start of use, when the closing of the discharge holes by the piston head section 31 is released by the movement of the center piston 3 in step S3, the plurality of kinds of contents immediately flow into the merging space 21 from the plurality of discharge holes 542*a* through 542*e*.

In this case, the plurality of contents from the plurality of discharge holes 542*a* through 542*e* may flow into the merging space 21 simultaneously, or may flow into the merging space 21 at respective timings in an order for every one or plurality of contents.

When the set predetermined amount of the plurality of kinds of contents flow into the merging space 21 (step S5), the piston motor 41 of the piston drive section 4 drives and raises the center piston 3 in step S6, so that the piston head section 31 moves from the second position to the first position in the merging space 21.

As the center piston 3 moves in step S6, the plurality of contents in the merging space 21 ride on the top surface 31U of the piston head section 31, and are pushed out to the same height as the upper surface (upper surface of the case) 11U, which is the discharge surface of the device case 10 (step S7).

Then, the user mixes the plurality of kinds of contents on the upper surface 11U of the head case 11 (step S8), and the user thereafter uses the mixture (step S9).

In this embodiment illustrated in FIG. 6 through FIG. 10B, because the plurality of kinds of contents ride on the top surface 31U of the piston head section 31 and reach the same position as the upper surface 11U of the device case 10, without being mixed and hardly receiving pressure inside the merging space 21, the user can enjoy the pleasure of mixing the contents by the user himself/herself. In this case, in the first embodiment, because the recess 15 is formed in the upper surface 11U, which is the discharge surface of the device case 10, at the portion in the periphery of the opening 14, the user can use the recess 15 as a tray, and efficiently mix the plurality of contents that are pushed out on the inside of the edge of the recess 15.

In addition, if the mixture is deposited on the upper surface 11U which is outside the discharge device 1 after the procedure of the flow chart described above, the user may preferably wipe off the adhered material with a tissue or the like.

Second Embodiment

Figure 14:
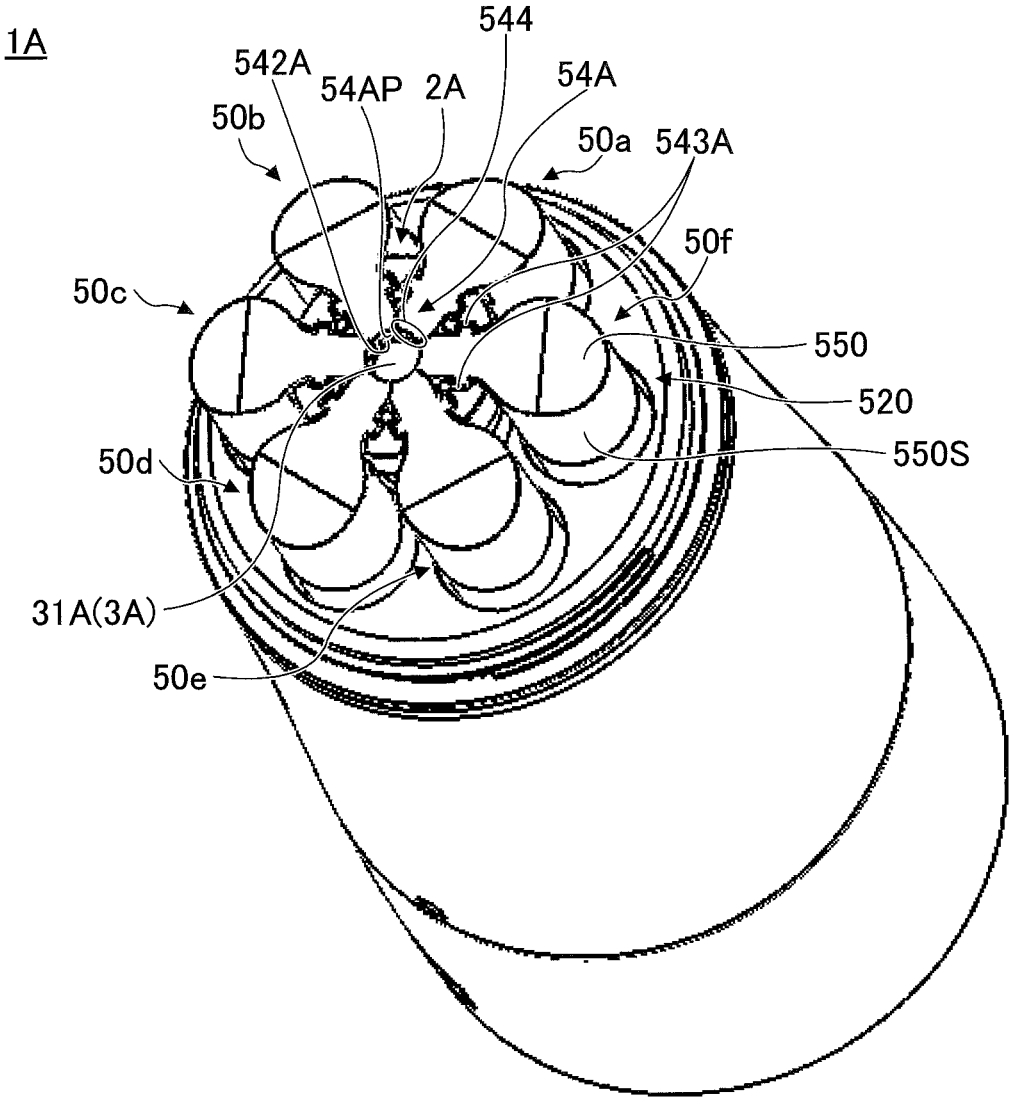
FIG. 14 is a perspective view illustrating the push-out mechanism of the discharge device according to a second embodiment of the present invention.
Figure 15:
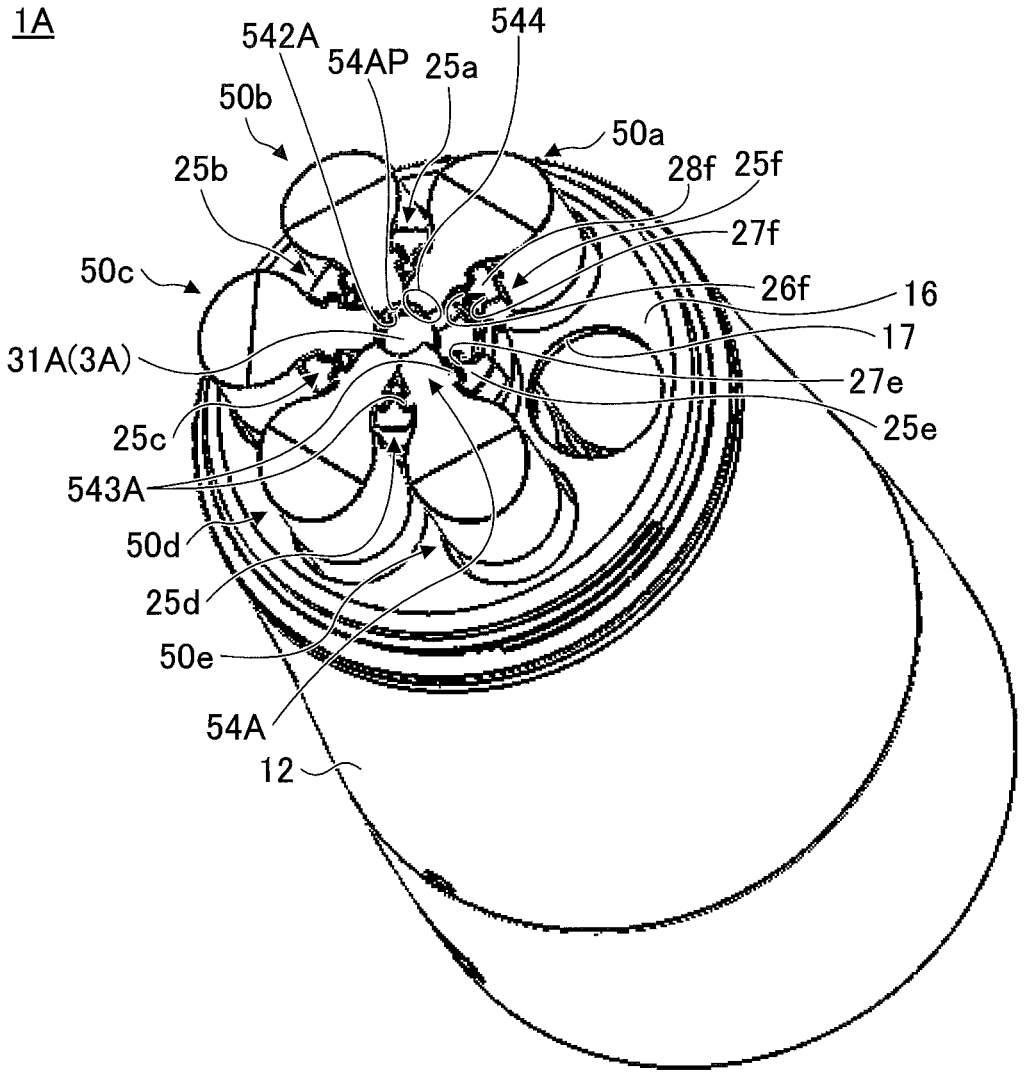
FIG. 15 is a perspective view illustrating the push-out mechanism of the discharge device according to the second embodiment of the present invention.

FIG. 14 is a perspective view illustrating the push-out mechanism of a discharge device 1A according to a second embodiment of the present invention. FIG. 15 is a perspective view of the push-out mechanism of the discharge device according to the second embodiment of the present invention in a state where one feeding container is removed.

In this embodiment, the plurality of feeding containers 50*a* through 50*f* are radially arranged above a cylindrical section 29 of a center support 2A, so that proximities of tip ends of nozzles 54A are adjacent to each other. In this example, six feeding containers 50*a* through 50*f* are provided inside the discharge device.

FIG. 14 and FIG. 15 illustrate an example in which a center piston 3A is located at a receiving position which is a lower position. As illustrated in FIG. 14 and FIG. 15, when the center piston 3A is located at the receiving position, the contents discharged from the plurality of feeding containers via the plurality of nozzles 54A merge in a merging space which is the space surrounded by nozzle discharge surfaces 54AP formed with a plurality of discharge holes 542A.

As illustrated in FIG. 14 and FIG. 15, in the discharge device 1A according to this embodiment, the feeding containers are arranged so that the proximities of the tip ends of the nozzles make contact with each other. For this reason, at an upper portion of the center support 2A, fixing sections 25*a* through 25*f* for fixing positions of the nozzles 54A are not provided near a center portion.

In addition, as illustrated in FIG. 15, the nozzle 54A, on the tip end side (center side), has a tip end 544 with a shape which narrows in the top view, so that the nozzles 54A can be arranged radially in contact with each other.

Figure 16:
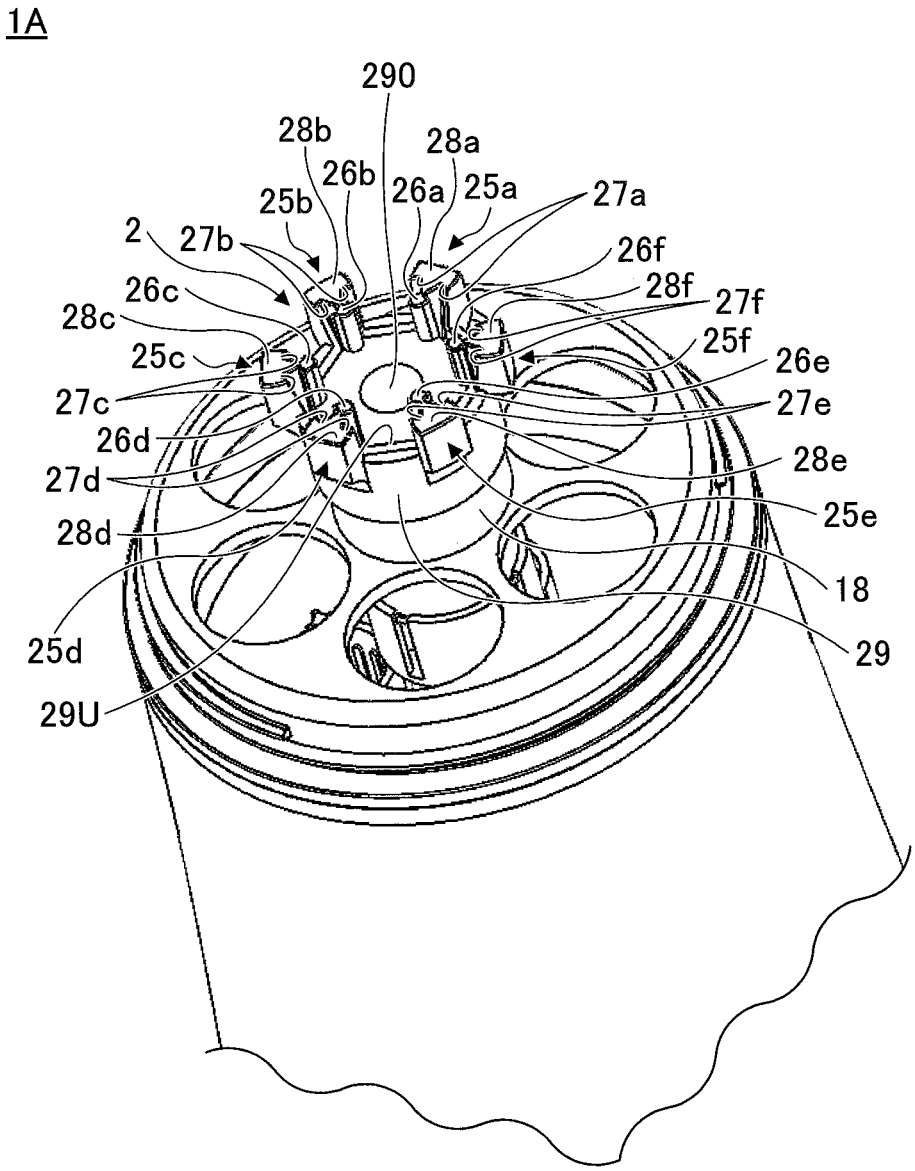
FIG. 16 is a perspective view illustrating the push-out mechanism of the discharge device according to the second embodiment of the present invention.

FIG. 16 is a perspective view of the push-out mechanism of the discharge device according to the second embodiment of the present invention, in a state where all of the feeding containers are removed.

As illustrated in FIG. 16, a number of fixing sections 25, equal to the number of the feeding containers 50*a* through 50*f*, are provided at the upper portion of the center support 2A, and a cylindrical section 29 is provided at a lower portion of the center support 2A. The center piston 3A is removed in FIG. 16, and a through hole 290, having an outer diameter which is approximately the same size as the periphery of the piston head section 31A of the center piston 3A, is formed in the center portion near the upper surface of the cylindrical section 29.

The plurality of nozzles 54A of the plurality of feeding containers 50*a* through 50*f* may be fixed between two fixing sections 25, respectively, and the fixing sections 25*a* through 25*f* are provided to extend outward with respect to the cylindrical section 29 at the lower portion. Each fixing section 25 includes a center end 26, a hollow step (hollow section) 27, and an outer periphery 28.

The center end 26 supports a portion immediately prior to the portions of adjacent nozzles 54A which make contact with each other. The nozzle 54A, which engages the center support 2A, has the tip end 544 with the narrowing tip extending outward at a location more on the center side than the center end 26, and the tip ends 544 of the adjacent nozzles 54A make contact with each other near the center above the cylindrical section 29.

The hollow step 27 is formed on a side surface of the fixing section 25, and is engageable with a projection 543A of the nozzle 54A.

The outer periphery 28 is located more on the outer peripheral side than the hollow step 27 of the fixing section 25, and the opposing side surfaces of the outer peripheries 28 of the two fixing sections 25 make contact with the nozzle 54A which is closer to a head base 550 (refer to FIG. 14) of the head section 520 than the projection 543A, thereby fixing the nozzle 54A.

Moreover, in this embodiment, the nozzles 54A of the feeding containers 5*a* through 5*f* have the external shape that extends in the horizontal direction in the rectangular column shape, except for the connecting portion which connects to a side surface 550S (refer to FIG. 14) of the head base 550, and the tip end 544 which has the narrowing tip in the top view. For this reason, as illustrated in FIG. 16, in the center support 2A, the side surfaces of the two fixing sections 25, and the portions surrounded by an upper end 29U of the cylindrical section 29, function as a fitting groove having a generally angular groove shape that surrounds and fixes the portion of the nozzle 54A other than the tip end 544.

However, in this embodiment, as long as the external shape of the nozzle 54A permits transfer of the contents in the transverse direction, and the portions of the tip ends 544 of the adjacent nozzles making contact with each other have similar shapes, the outer peripheries of the nozzles 54A making contact with the fixing sections 25*a* through 25*f* may have other shapes.

For example, the external shape of the outer periphery of the nozzle 54A may be a rounded rectangular column shape with rounded corners, a lateral cylinder shape, a lateral semicircular column shape protruding downward, a lateral triangular column shape, or a lateral polygonal column shape. In this case, the shape of the portion surrounded by the side surfaces of the two fixing sections 25 and the upper end 29U of the cylindrical section 29, forming the fitting groove in the center support 2A, may have a shape in accordance with the external shape of the nozzle 54A, such as the shape of a chamfered U-groove, a groove having a semicircular cross section, a V-groove, or a groove having a lower half with a polygonal cross section.

In this embodiment, the device case (head case) 11 (refer to FIG. 9) having the discharge surface formed with an opening may be provided outside the head section 520 of the feeding containers 50*a* through 50*f*.

The center piston 3A is moved from the push-out position (upper position) to the receiving position (lower position) to release the plurality of nozzle discharge surfaces 54AP and put the merging space surrounded by the nozzle discharge surfaces 54AP in a communicating state, and after the contents flow into the merging space, the center piston 3A is moved from the receiving position to the push-out position to push out the contents flowing into the converging space outside of the discharge surfaces via the opening.

Third Embodiment

Figure 17:
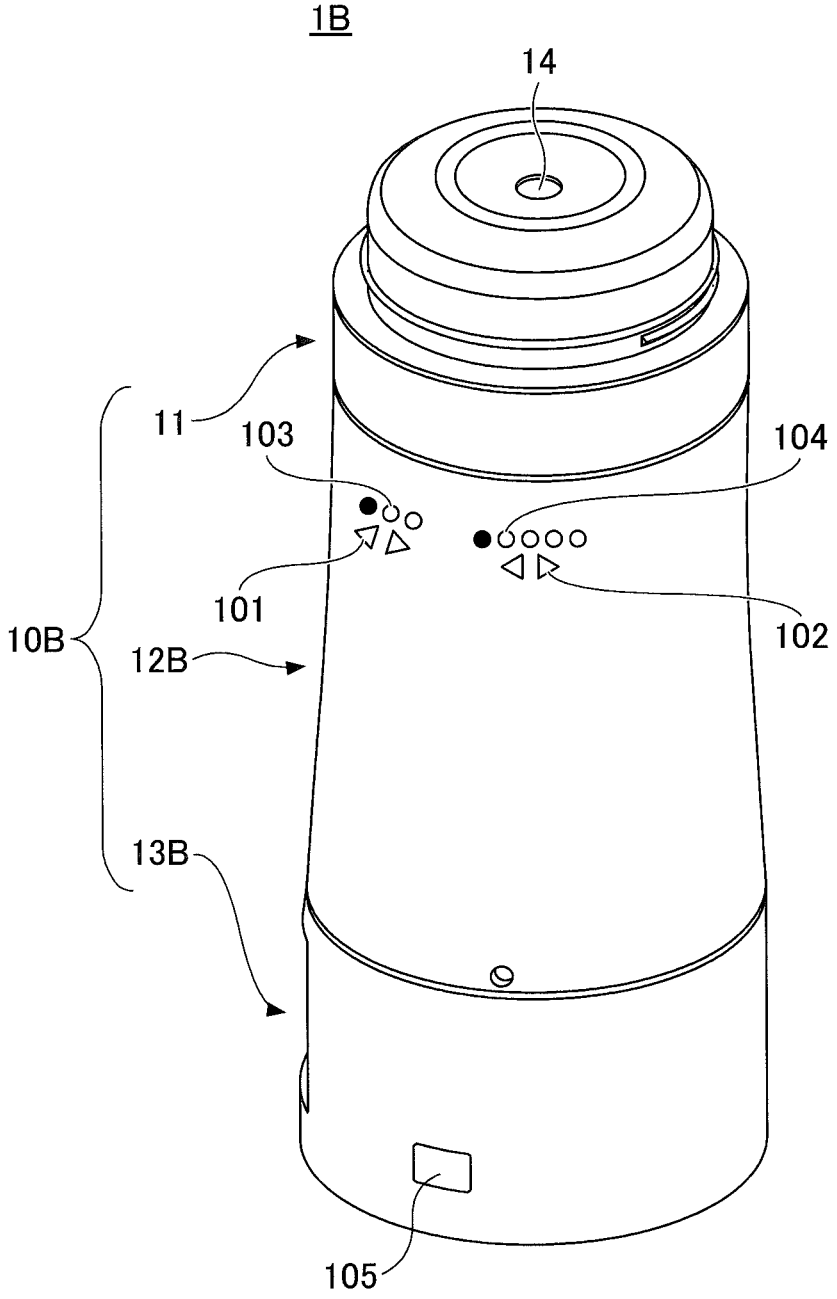
FIG. 17 is an external view of the discharge device according to a third embodiment of the present invention.

FIG. 17 is an external view of the discharge device according to a third embodiment of the present invention.

In this embodiment, the operating sections (operation switches) 101 and 102, the light emitting sections 103 and 104, and the power switch 105, for example, are provided in a device case 10B of a discharge device 1B.

The left operating section 101 illustrated in FIG. 17 adjusts the discharge amount (mixing ratio) of the discharging contents. In addition, the right operating section 102 selects a target for which the discharge amount is to be adjusted, and the light emitting section 104 indicates information on the kinds of contents for which the amount is to be adjusted by the right operating section 102. The light emitting section 103 turns on to indicate a selected discharge amount selected by the left operating section 101. FIG. 17 illustrates an example in which the discharge amount can be selected in three stages.

In FIG. 17, two sets of operating sections and light emitting sections are illustrated, however, the discharge device 1 may be provided with three or more sets of operating sections and light emitting sections. For example, the operating section may be provided independently for each of the contents.

According to the configuration which selects the discharge amount in three steps, "no discharge" of the contents is indicated when none of the elements of the light emitting section 103 turns on, a "small discharge amount" of the contents is indicated when one element of the light emitting section 103 turns on, a "medium discharge amount" of the contents is indicated when two elements of the light emitting section 103 turns on, and a "large discharge amount" of the contents is indicated when three elements of the light emitting section 103 turns on.

The number of operating sections 101 and 102 may be increased or decreased depending on the number of kinds of contents inside the discharge device 1. In addition, although the shapes of the operating sections 101 and 102 illustrated in FIG. 17 are triangular, the operating sections 101 and 102 may have other shapes as long as the discharge amount of the contents can be selected. Moreover, although the operating section for the selection includes functional buttons for increasing and decreasing the discharge amount according to pointing directions of the triangular shapes, the functional buttons may be reduced to a single button which changes the discharge amount in only the increasing direction, for example.

Further, the buttons illustrated in FIG. 17 may be a pressable convex button, or may be a touch sensor provided on the surface of the case and including no concavo-convex portion at the surface of the case. Alternatively, a touch-screen panel may be provided in place of the button type operating section.

The power switch 105 turns the power supply 91 of the discharge device 1 on and off.

Fourth Embodiment

Figure 18:
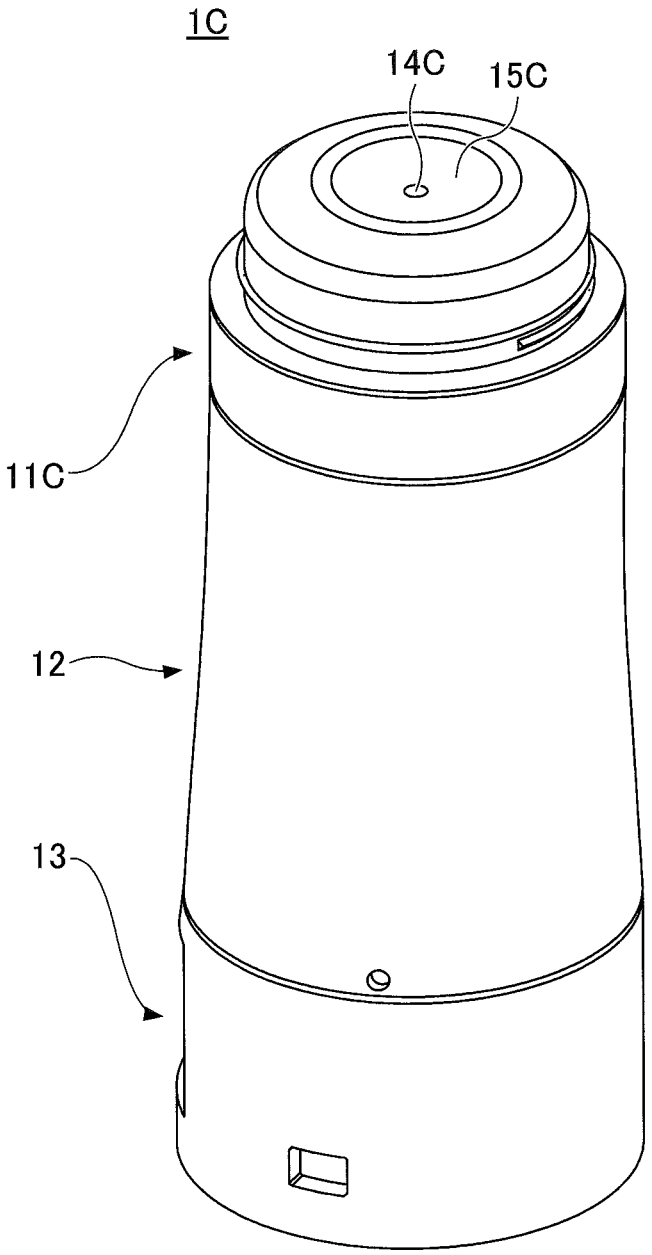
FIG. 18 is an external view of the discharge device according to a fourth embodiment of the present invention.

FIG. 18 is an external view of the discharge device according to a fourth embodiment of the present invention.

A discharge device 1C according to this embodiment differs from that illustrated in FIG. 9, in that the discharge hole in the upper surface is small.

Because a diameter of an opening 14C is small in this embodiment as described above, the plurality of kinds of contents to be discharged are transferred to a recess 15C, which is the discharge surface, after receiving pressure. For this reason, in the discharge device 10 according to this embodiment, the contents are pushed out while being slightly mixed.

Accordingly, the user can enjoy the state where the slightly mixed contents are gradually pushed out, and reduce the time required for the user to mix the contents pushed out from the opening 14C, which is the discharge hole, in the recess 15C, which is the discharge surface.

FIG. 18 illustrates an example in which the opening, which is the discharge hole of the discharge device, is small, and the discharge device is operated from the information processing terminal that is connected to the device via the network, however, even in the configuration in which the discharge hole is small, the operating section may be provided in a main body of the discharge device 10, as illustrated in FIG. 17.

Fifth Embodiment

Figure 19:
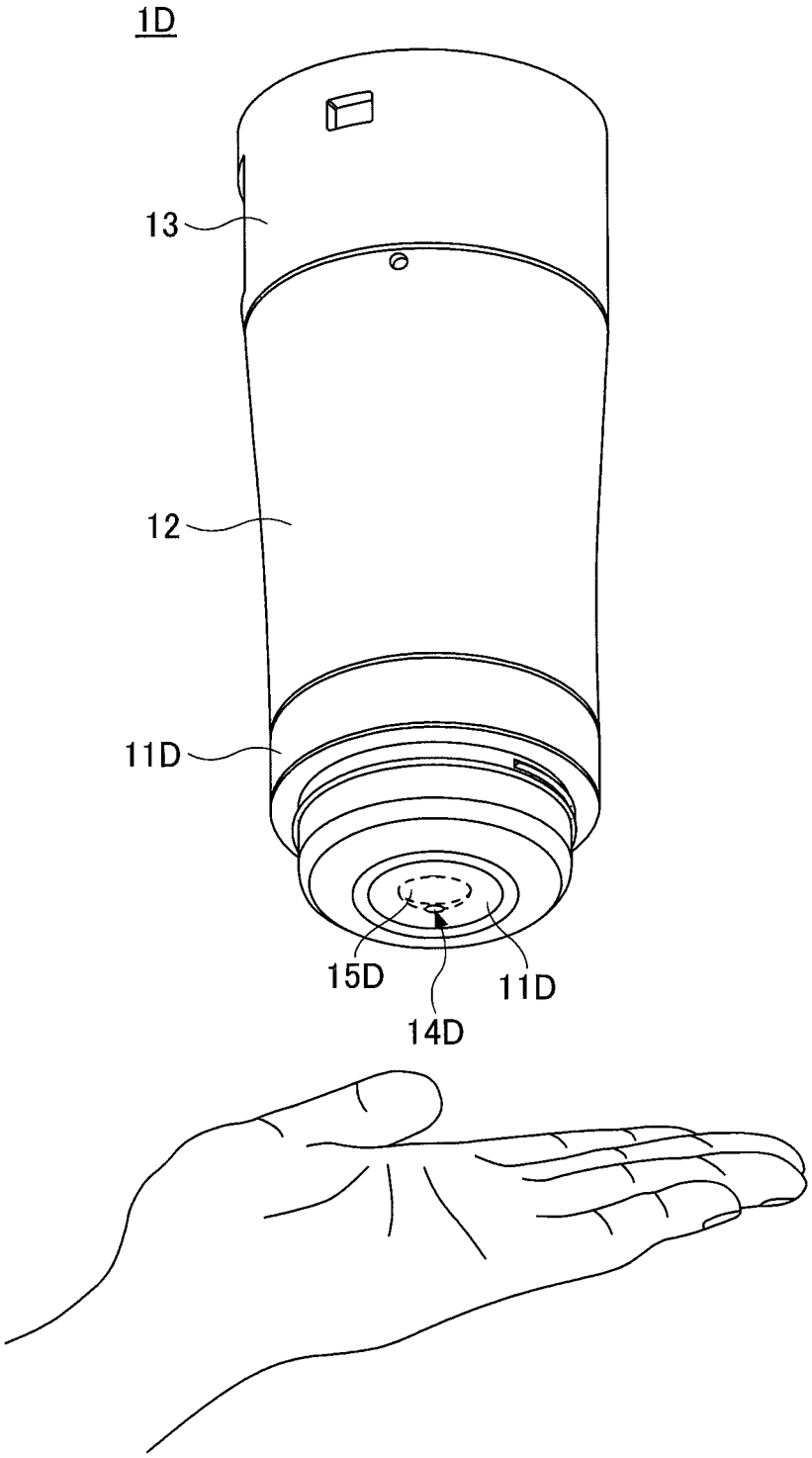
FIG. 19 is an external view illustrating a state of use of the discharge device according to a fifth embodiment of the present invention.

FIG. 19 is an external view illustrating a state of use of the discharge device according a fifth embodiment of the present invention.

In the examples of the embodiments described above, the discharge devices 1, 1A, 1B, and 1C are arranged so as to discharge the contents upward, however, the discharge direction is not particularly limited in the discharge device according to the present invention, and it is possible to employ a configuration which discharges the contents downward as illustrated in FIG. 19.

When the discharge device 1D is arranged so as to discharge the contents downward as illustrated in FIG. 19, the contents may be discharged onto the hand of the user to be mixed on a palm of the user's hand, similar to a hand wash dispenser.

This embodiment illustrates an example in which the discharge surface formed with a small diameter opening 14D is a lower surface 11D of a device case 10D, and for this reason, the center piston 3 inside the device case 10D is movable up and down between the lower first position and the upper second position. According to this configuration, when the power is turned off, or after the discharge in the power on state and in a standby position, the center piston 3 is located at the lower first position, and the lower surface 11D, which is the discharge surface, and the lower surface of the center piston 3 are at approximately the same height.

Further, in the feeding containers 5*a* through 5*e*, when the operation cylinder 56 rotates, the piston 59 moves downward from the upper position to the lower position, to push out the contents in the horizontal direction via the nozzle 54 of the head section 52 provided below.

When discharging the contents downward from the discharge device 1D, the contents preferably have a high viscosity by taking gravity into consideration. In addition, by taking the gravity into consideration, it is preferable in this example of use that the opening 14D is configured to have a diameter smaller than the diameter of the discharge space to which the opening 14D communicates, as illustrated in FIG. 18 described above.

Moreover, in the case where the contents are discharged downward as illustrated in FIG. 19, the periphery of the opening 14D is preferably formed as a convex portion 15D projecting in a mountain shape from the lower surface 11D, rather than being configured to have the mortar shape as in the first through fourth embodiments.

FIG. 19 illustrates the example of the configuration in which the contents are discharged downward, and the discharge device is operated from the information processing terminal that is connected to the discharge device via the network, however, even in the configuration in which the contents are discharged downward, the operating section may be provided in a main body of the discharge device 1D, as illustrated in FIG. 17.

Although FIG. 19 illustrates the configuration in which the contents are discharged downward, the discharging direction is not limited to the up-and-down direction, and may be the lateral direction.

Sixth Embodiment

Figure 20A:
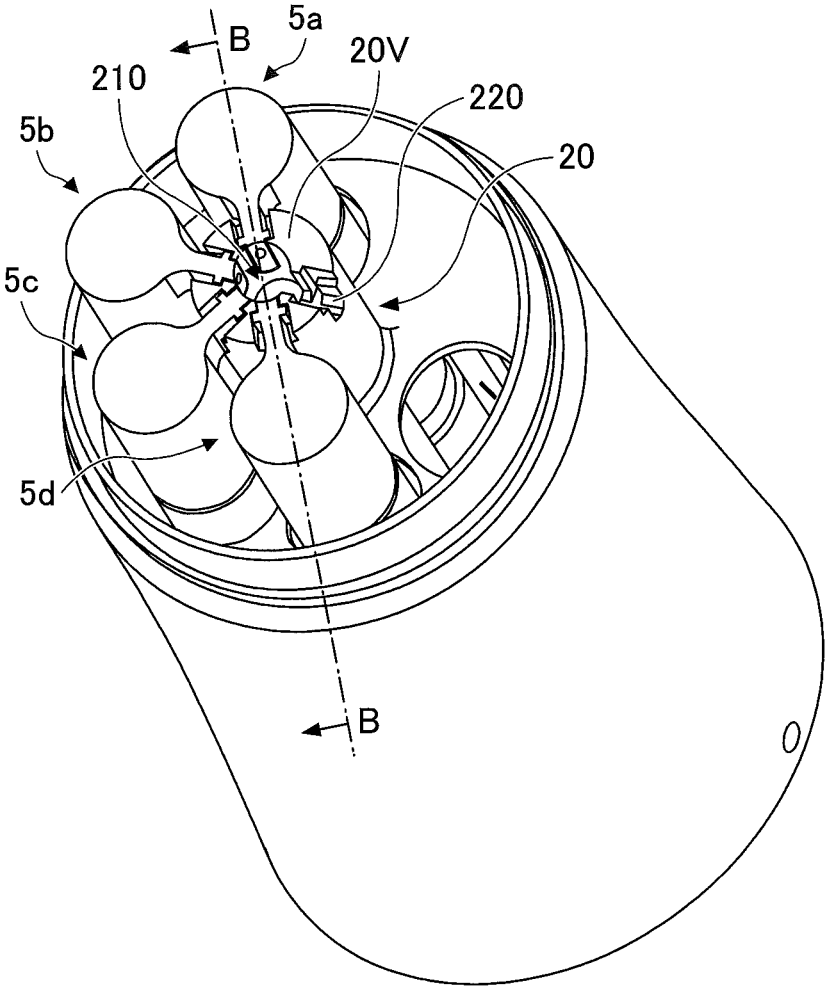
FIG. 20A is an exploded perspective view of the discharge device according to a sixth embodiment of the present invention.
Figure 20B:
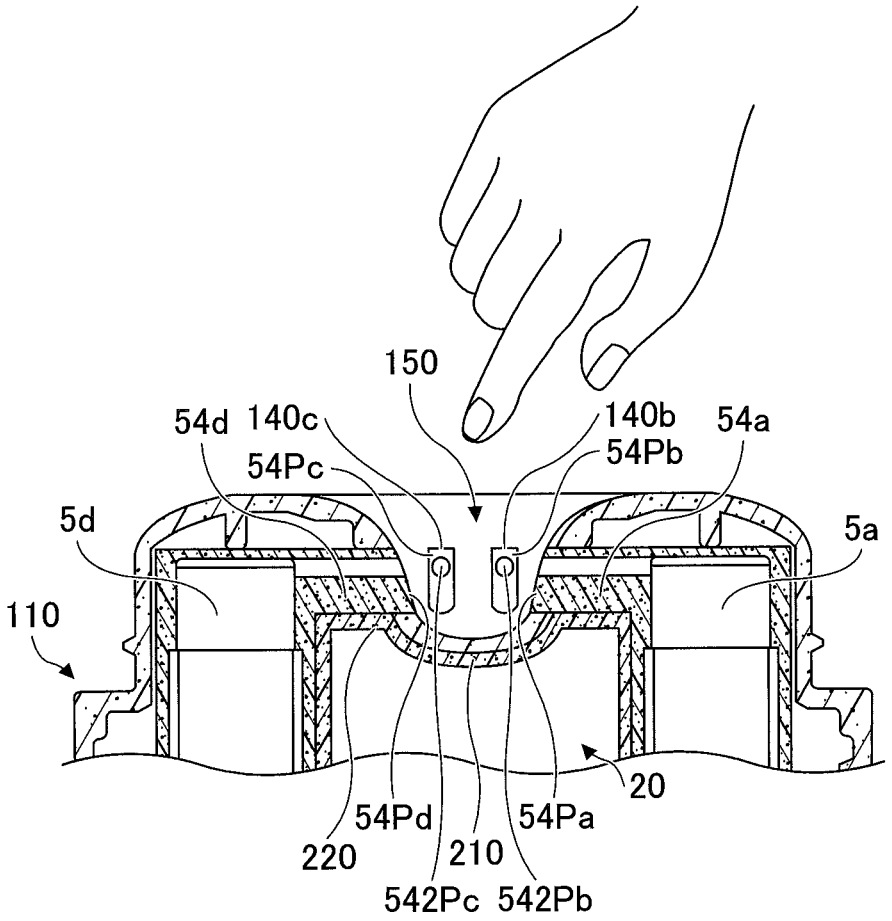
FIG. 20B is a cross sectional view illustrating the discharge device according to the sixth embodiment of the present invention.

FIG. 20A and FIG. 20B are diagrams for explaining the discharge device according to a sixth embodiment of the present invention. FIG. 20A is an exploded perspective view of the discharge device, and FIG. 20B is a cross sectional side view of the discharge device along a line B-B in FIG. 20A.

In FIG. 6 through FIG. 19 described above, the contents discharged from the plurality of feeding containers are pushed out by the configuration using the center piston, however, it is not essential to provide the center piston in the discharge device provided with the plurality of feeding containers.

In this configuration, a recess 210 is formed in the center of the upper surface of the columnar body 20. In addition, a plurality of fitting grooves 220 are formed radially in an upper surface 20V of the columnar body 20, so as to penetrate the center recess 210 and the outer surface of the columnar body 20, so that nozzles 54Pa through 54Pe of the plurality of feeding containers 5*a* through 5*e* can be fit from above, similar to the embodiments described above.

In this embodiment, the nozzles 54 of the feeding containers 5*a* through 5*e* are provided so as to protrude inward from an inner wall of the recess 210 of the columnar body 20.

Moreover, according to this configuration, an outer recess 150, having a shape along the recess 210 of the columnar body 2, is provided on the upper surface of the head case 110 of the discharge device 1D. A plurality of fitting holes 140*a* through 140*e*, to which the tip ends protruding from the recess 210 of the nozzles 54*a* through 54*e* can fit, are formed in a side surface of the outer recess 150. A discharge surface 54Pb and a discharge hole 542*b* fitted into the fitting hole 140*b*, and a discharge surface 54Pc and a discharge hole 542*c* fitted into the fitting hole 140*c*, are visible in FIG. 20B, however, similar configurations are applicable to the other feeding containers.

The side surface of the outer recess 150 in an upper surface 110U of the head case 110 is formed to be continuous with the discharge surface 54P formed with the discharge hole 542, which is the nozzle hole in the nozzles 54*a* through 54*e*. In FIG. 20B, the discharge surface 54Pa and the discharge surface 54Pd are approximately on the same plane as the cross section of the outer recess 150, however, similar configurations are applicable to the other feeding containers.

The contents discharged from the plurality of feeding containers through the plurality of nozzles merge in the outer recess 150 of the head case 110 via the discharge holes 542*a* through 542*e*. The user may wipe the contents merged in the outer recess 150 using the user's fingers, cotton, cotton swab, or the like, to use the contents.

FIG. 20A illustrates an example in which the columnar body 20 has the recess with a size surrounding the piston, as illustrated in FIG. 7 and FIG. 8, but in the configuration illustrated in FIG. 20B, each of the recess 210 and the outer recess 150 preferably have a diameter that is large and a depth that is shallow to such an extent that enables the user's fingers to be inserted therein.

Contents (cosmetic materials) having different colors are described as the contents in the examples described above, however, it is possible to use contents having different tactile sensations or the like, for example.

For example, in a case where a basic cosmetic material is discharged using the contents having different tactile sensations, information such as "plain", "moist", "average", "sensitive", "whitening", "pimple treating measures", "facial pack", or the like is selected from the information processing terminal 200 according to the skin condition, the ambient air temperature and humidity, and the mood of the user, so as to compute the mixing ratio of the contents capable of achieving a tactile sensation for the skin suited for the selection that is made. The contents having the different tactile sensations are components that affect the viscosity, and contents specialized for different functions, such as basic components, thickening components (moisturizing components), astringent components, whitening components (vitamin C or the like), pimple treating components, or the like, may be accommodated in advance as the contents having the different tactile sensations.

The computed information is transmitted to the discharge device 1, and the discharge device 1 simultaneously discharges the plurality of contents having the different viscosities (tactile sensation for the skin) with a predetermined mixing ratio based on the received information. The discharged contents are mixed to form the basic cosmetic material that achieves a predetermined effect.

In addition, when the cosmetic material for the base makeup is discharged using contents having different light reflectivities or the like, "natural", "gloss (glitter)", "matte", or the like may be selected according to the skin condition, the ambient air temperature and humidity, and the mood of the user, to adjust the mixing ratio of the contents even for the same color, and enable suitable selection and discharge of the cosmetic materials having the different light reflectivities with respect to the skin.

In the discharge device according to the present invention described above, the contents are stored and transferred separately until reaching the discharge space. For this reason, it is possible to use the contents without causing separation or deterioration, by mixing, immediately before use, the plurality of contents having properties which would cause separation or deterioration if left to stand. Examples of such contents include vitamin C containing cosmetic materials, hairdressing agents, or the like.

Moreover, the examples described above assume that the discharge device according to the present invention is for home use, and the user suitably selects and uses the discharge device. However, the discharge device is also suited for use at shop counters. By adjusting the mixing ratio at the counter, it is possible to set the mixing ratio of the contents according to the complexion and preference of each customer.

Further, although cosmetics that cause visual changes are used as the contents in the examples described above, liquids or viscous products having fragrances (perfumes, solid perfumes such as body creams, hand creams, or the like) may be accommodated as the contents. By using the perfumes or solid perfumes as the contents, the user can customize the fragrances.

In addition, although the contents are cosmetics in the examples described above, liquid or viscous seasonings may be accommodated as the contents. By accommodating the seasonings, the user can customize the flavor, prepare amounts of seasonings to be used for the cooking in advance without the use of measuring instruments.

Although preferred embodiments of the present invention are described above in detail, the present invention is not limited to the specific embodiments described above, and various variations and modifications may be made within the scope of the subject matter of the present invention as recited in the claims.

This application is based upon and claims priority to Japanese Patent Application No. 2018-169200, filed on Sep. 10, 2018, the entire contents of which are incorporated herein by reference.

DESCRIPTION OF THE REFERENCE NUMERALS

1, 1A, 1B, 1C, 1D Discharge device
10 Device case
11, 110 Head case
11U Upper surface (discharge surface)

14 Opening
140 Fitting hole
15 Recess
150 Outer recess
16 Beam section
18 Support cylinder
2 Columnar body
2A Center support
21 Merging space
22 (22*a*, 22*b*, 22*c*, 22*d*, 22*e*) Fitting groove (groove)
23 Engaging groove (groove)
24 Tubular section
25 (25*a*, 25*b*, 25*c*, 25*d*, 25*e*, 25*f*) Fixing section
27 (27*a*, 27*b*, 27*c*, 27*d*, 27*e*, 27*f*) Hollow step (hollow section)
3, 3A Piston
31, 31A Piston head (head)
4 Piston drive section (drive section)
41 Drive motor
42 Rotating shaft
43 Rotation transmission cylinder
5 (5*a*, 5*b*, 5*c*, 5*d*, 5*e*), 5α, 5β Feeding container
50 (50*a*, 50*b*, 50*c*, 50*d*, 50*e*, 50*f*) Feeding container
51 Body cylinder (container body)
510 Accommodating chamber (container body)
52, 520 Head section (container body)
53 Feeding section
54 (54*a*, 54*b*, 54*c*, 54*d*, 54*e*) Nozzle
54U Upper surface of nozzle
54S Side surface of nozzle
54P, 54AP Discharge surface
541 Nozzle passage
542 (542*a*, 542*b*, 542*c*, 542*d*, 542*e*), 542A Discharge hole (feeding hole)
543 Projection
544 Tip end
55, 550 Head base
55S, 550S Side surface
55U Upper surface
55V Flat upper surface
56 Operation cylinder
57 Moving shaft
58 Rotation restricting section
59 Piston
6 Push-out section
61 Drive motor
62 Rotating shaft
63 Transmission shaft
7 Support plate
94 Supply controller (controller)
200 Computer (information processing terminal)
300 Smartphone (information processing terminal)
C Contents
S Step

The invention claimed is:

1. A feeding container comprising:

a container body including a body cylinder having a side surface and capable of accommodating contents;

a head section attached above the body cylinder;

a nozzle provided in an upper portion of the container body and integrally formed with the head section, the contents contained in the container body being discharged from the nozzle as a piston provided inside the container body rises, and wherein the nozzle extends in a horizontal direction, and pushes out the contents in the horizontal direction via a discharge hole which opens in the horizontal direction; and a projection, provided on an extending side surface of the nozzle, and projecting in a direction intersecting an extending direction of the nozzle.

2. A discharge device comprising:

a plurality of feeding containers respectively having a structure of the feeding container according to claim 1;

a columnar body having an upper surface with a recess which is recessed toward the inside in a mortar shape at a center of the upper surface; and a device case having a discharge surface with an outer recess formed along the recess, wherein a plurality of fitting grooves are formed radially in the upper surface of the columnar body so as to penetrate the recess at the center and an outer surface of the columnar body, so that a plurality of nozzles of the plurality of feeding containers can be fit from above the plurality of fitting grooves, wherein a plurality of fitting holes to which the plurality of nozzles can fit, are formed in a side surface of the outer recess, wherein the side surface of the outer recess of the device case is formed to be continuous with the discharge surface formed with a plurality of discharge holes of the plurality of nozzles, and wherein the contents discharged from the plurality of feeding containers via the plurality of nozzles thereof merge in the outer recess.

3. A discharge device comprising:

a plurality of feeding containers respectively having a structure of the feeding container according to claim 1; and a center support having a plurality of fixing sections provided at an upper portion thereof, and a cylindrical section provided at a lower portion thereof, wherein a number of the plurality of fixing sections is equal to a number of the plurality of feeding containers, wherein each of a plurality of nozzles of the plurality of feeding containers are fixable between two adjacent fixing sections of the plurality of fixing sections, wherein a plurality of hollow steps, engageable with a plurality of projections of the plurality of nozzles, are formed on side surfaces of the plurality of fixing sections, respectively, wherein the plurality of feeding containers are arranged radially above the cylindrical section of the center support so that proximities of tip ends of the plurality of nozzles are adjacent to one another, and wherein the contents discharged from the plurality of feeding containers via the plurality of nozzles merge in a space surrounded by a plurality of nozzle discharge surfaces of the plurality of nozzles.

4. The discharge device as claimed in claim 3, further comprising:

a center piston, fitted in the space surrounded by the plurality of nozzle discharge surfaces, and movable up and down inside the space surrounded by the plurality of nozzle discharge surfaces and inside an inner peripheral surface of the cylindrical section, wherein a plurality of discharge holes of the plurality of nozzles communicate with the space surrounded by the plurality of nozzle discharge surfaces in a state where the center piston is located at a receiving position, thereby enabling the contents to flow into the space surrounded by the plurality of nozzle discharge surfaces via the plurality of discharge holes, and the plurality of discharge holes are closed by the center piston in a state where the center piston is located at a push-out position.

5. The feeding container as claimed in claim 1, further comprising:

a feeding section fitted to a lower portion of the container body and rotating with respect to the container body, thereby reducing an internal volume inside the container body by raising the piston.

6. A discharge device comprising:

a plurality of feeding containers respectively having a structure of the feeding container according to claim 5; and a center support having a plurality of fixing sections provided at an upper portion thereof, and a cylindrical section provided at a lower portion thereof, wherein a number of the plurality of fixing sections is equal to a number of the plurality of feeding containers, wherein each of a plurality of nozzles of the plurality of feeding containers are fixable between two adjacent fixing sections of the plurality of fixing sections, wherein a plurality of hollow steps, engageable with a plurality of projections of the plurality of nozzles, are formed on side surfaces of the plurality of fixing sections, respectively, wherein the plurality of feeding containers are arranged radially above the cylindrical section of the center support so that proximities of tip ends of the plurality of nozzles are adjacent to one another, and wherein the contents discharged from the plurality of feeding containers via the plurality of nozzles merge in a space surrounded by a plurality of nozzle discharge surfaces of the plurality of nozzles.

7. The feeding container as claimed in claim 5, wherein the nozzle has an external shape that extends in the horizontal direction in a rectangular column shape, except for a connecting portion which connects to a side surface of the container body, and the discharge hole of the nozzle is positioned at an upper portion of a nozzle discharge surface.

8. A discharge device comprising:

a plurality of feeding containers respectively having a structure of the feeding container according to claim 7; and a center support having a plurality of fixing sections provided at an upper portion thereof, and a cylindrical section provided at a lower portion thereof, wherein a number of the plurality of fixing sections is equal to a number of the plurality of feeding containers, wherein each of a plurality of nozzles of the plurality of feeding containers are fixable between two adjacent fixing sections of the plurality of fixing sections, wherein a plurality of hollow steps, engageable with a plurality of projections of the plurality of nozzles, are formed on side surfaces of the plurality of fixing sections, respectively, wherein the plurality of feeding containers are arranged radially above the cylindrical section of the center support so that proximities of tip ends of the plurality of nozzles are adjacent to one another, and wherein the contents discharged from the plurality of feeding containers via the plurality of nozzles merge in a space surrounded by a plurality of nozzle discharge surfaces of the plurality of nozzles.

9. A discharge device comprising:

a plurality of feeding containers respectively having a structure of the feeding container according to claim 1; and a columnar body having a merging space formed at a center thereof and extending in an up-and-down direction, wherein a plurality of fitting grooves are formed radially in an upper surface of the columnar body so as to penetrate the merging space at the center and an outer surface of the columnar body, so that a plurality of nozzles of the plurality of feeding containers can be fit from above the plurality of fitting grooves, wherein a plurality of engaging grooves, engageable with a plurality of projections of the plurality of nozzles and extending from the plurality of the fitting grooves, are formed in the upper surface of the columnar body, and wherein the contents discharged from the plurality of feeding containers via the plurality of nozzles thereof merge in the merging space.

10. The discharge device as claimed in claim 9, further comprising:

a center piston, fitted in the merging space and movable up and down inside the merging space, wherein a plurality of discharge holes of the plurality of nozzles communicate with the merging space in a state where the center piston is located at a receiving position, thereby enabling the contents to flow into the merging space via the plurality of nozzles of the plurality of discharge holes, and wherein the plurality of discharge holes are closed by the center piston in a state where the center piston is located at a push-out position.

11. The discharge device as claimed in claim 10, further comprising:

a device case having a discharge surface formed with an opening, wherein after the center piston moves from the push-out position to the receiving position and the plurality of discharge holes of the plurality of nozzles and the merging space communicate with one another, to flow the contents into the merging space, the center piston moves from the receiving position to the push-out position to push out the contents flowing into the merging space from the opening to the outside of the discharge surface.

12. The discharge device as claimed in claim 9, further comprising:

a plurality of drive sections configured to drive and raise the piston provided in the plurality of feeding containers, respectively; and a controller configured to control supply amounts of the contents to be fed from the plurality of feeding containers by the drive of the plurality of drive sections.

13. A customized discharge system comprising:

the discharge device according to claim 12; and an information processing terminal connectable to the discharge device via a network, wherein discharge amounts of the contents are instructed from the information processing terminal.

* * * * *